US012710053B2

(12) United States Patent
Daniel et al.

(10) Patent No.: US 12,710,053 B2
(45) Date of Patent: Aug. 18, 2026

(54) BLADELESS FANS WITH A NOZZLE

(71) Applicant: SharkNinja Operating LLC, Needham, MA (US)

(72) Inventors: Jason Daniel, Needham, MA (US); Alireza Hooshanginejad, Medway, MA (US); Scott James Stewart, Boston, MA (US); Rajiv Mistry, Durham (GB); James Potter, London (GB); Steven Luke Bailey, Lancashire (GB); Steven Godden, Woking (GB); Matthew Roberts, Medfield, MA (US); Samuel Benjamin Baldry, Northamptonshire (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 19/059,057

(22) Filed: Feb. 20, 2025

(65) Prior Publication Data

US 2025/0305516 A1 Oct. 2, 2025

Related U.S. Application Data

(60) Provisional application No. 63/573,176, filed on Apr. 2, 2024.

(51) Int. Cl.
*F04D 29/40* (2006.01)
*F04D 19/00* (2006.01)
(Continued)

(52) U.S. Cl.
CPC ..... *F04D 29/403* (2013.01); *F04D 19/002* (2013.01); *F04D 25/105* (2013.01); *F04F 5/16* (2013.01)

(58) Field of Classification Search
CPC ..... F04D 29/403; F04D 29/26; F04D 29/563; F04D 19/002
See application file for complete search history.

(56) References Cited

U.S. PATENT DOCUMENTS 6,842,997 B1 1/2005 Fratello et al.
8,092,166 B2 1/2012 Nicolas et al.
(Continued)

FOREIGN PATENT DOCUMENTS

CA 3067242 C 7/2022
CN 102661294 B 10/2014
(Continued)

OTHER PUBLICATIONS

U.S. Appl. No. 19/059,028, filed Feb. 20, 2025, Bladeless Fans With a Nozzle.
(Continued)

*Primary Examiner* — Michael L Sehn
(74) *Attorney, Agent, or Firm* — Mintz, Levin, Cohn, Ferris, Glovsky and Popeo, P.C.

(57) ABSTRACT

A bladeless fan is provided. In one embodiment, a bladeless fan is provided having a base, a support arm extending from the base, and a fan arm movably coupled to the support arm. The fan arm can have nozzles configured to emit airflow along a plane. The base, support arm, and fan arm can be configured to allow independent adjustment of an amount of airflow from each of the nozzles, independent adjustment of a direction of airflow from each of the nozzles, and adjustment of a position of the plane.

19 Claims, 15 Drawing Sheets

(51) Int. Cl.
*F04D 25/10* (2006.01)
*F04F 5/16* (2006.01)

(56) References Cited

U.S. PATENT DOCUMENTS

| | | | |
|---|---|---|---|
| 8,128,245 | B2 | 3/2012 | Limjoco |
| D672,023 | S | 12/2012 | Wallace et al. |
| 8,348,629 | B2 | 1/2013 | Fitton et al. |
| 8,430,624 | B2 | 4/2013 | Cookson et al. |
| 8,469,655 | B2 | 6/2013 | Gammack |
| 8,469,660 | B2 | 6/2013 | Dyson et al. |
| 8,613,601 | B2 | 12/2013 | Helps |
| 8,708,650 | B2 | 4/2014 | Crawford et al. |
| 8,734,109 | B2 | 5/2014 | He et al. |
| 8,894,377 | B2 | 11/2014 | Greenberg |
| 8,961,152 | B2 | 2/2015 | Wark et al. |
| 9,004,878 | B2 | 4/2015 | Gammack et al. |
| 9,249,810 | B2 | 2/2016 | Gammack et al. |
| 9,334,872 | B2 | 5/2016 | Wark |
| 9,410,711 | B2 | 8/2016 | Wilson et al. |
| 9,611,864 | B2 | 4/2017 | Childe et al. |
| 9,624,940 | B2 | 4/2017 | Jones et al. |
| 9,624,941 | B2 | 4/2017 | Dymond et al. |
| 9,797,612 | B2 | 10/2017 | Staniforth et al. |
| 9,797,613 | B2 | 10/2017 | Staniforth et al. |
| 9,848,745 | B2 | 12/2017 | Hill et al. |
| 9,863,429 | B2 | 1/2018 | Jones et al. |
| 9,926,940 | B2 | 3/2018 | Mockridge |
| 10,024,330 | B2 | 7/2018 | Xie et al. |
| 10,145,388 | B2 | 12/2018 | Simmonds et al. |
| 10,206,486 | B2 | 2/2019 | Zimmerman |
| 10,221,860 | B2 | 3/2019 | Gammack et al. |
| 10,344,776 | B2 | 7/2019 | Lamb |
| 10,408,478 | B2 | 9/2019 | Staniforth et al. |
| 10,595,522 | B2 | 3/2020 | Zheng et al. |
| 10,688,897 | B2 | 6/2020 | Prozzi et al. |
| 10,855,124 | B2 | 12/2020 | Clothier et al. |
| 11,022,146 | B2 | 6/2021 | Mogridge et al. |
| 11,110,380 | B2 | 9/2021 | Biltcliffe et al. |
| 11,128,198 | B2 | 9/2021 | Barnes et al. |
| 11,492,106 | B2 | 11/2022 | Noppel et al. |
| 11,549,513 | B2 | 1/2023 | Daneshkhah et al. |
| 11,629,727 | B2 | 4/2023 | Cai |
| 11,767,859 | B2 | 9/2023 | Peet et al. |
| 11,920,614 | B2 | 3/2024 | Ying |
| 2010/0226749 | A1 | 9/2010 | Gammack et al. |
| 2011/0236229 | A1 | 9/2011 | Fitton et al. |
| 2013/0234347 | A1 | 9/2013 | Staniforth et al. |
| 2013/0269208 | A1 | 10/2013 | Gammack et al. |
| 2019/0242392 | A1 | 8/2019 | Whitmire |
| 2019/0264698 | A1 | 8/2019 | Parel |
| 2021/0095681 | A1 | 4/2021 | Adkin et al. |
| 2021/0270283 | A1 | 9/2021 | Macqueen et al. |
| 2021/0283544 | A1 | 9/2021 | Jennings et al. |
| 2021/0353974 | A1 | 11/2021 | Courtney et al. |
| 2022/0196023 | A1 | 6/2022 | Sullivan |
| 2024/0229815 | A1 | 7/2024 | Corralejo Anton et al. |

FOREIGN PATENT DOCUMENTS

| | | | |
|---|---|---|---|
| CN | 104763689 | A | 7/2015 |
| CN | 103452816 | B | 2/2016 |
| CN | 103486009 | B | 2/2016 |
| CN | 104389768 | B | 7/2017 |
| CN | 105822593 | B | 7/2018 |
| CN | 106224212 | B | 7/2018 |
| CN | 106438513 | B | 8/2018 |
| CN | 106481589 | B | 12/2018 |
| CN | 107605813 | B | 3/2019 |
| CN | 209083703 | U | 7/2019 |
| CN | 105781947 | B | 8/2019 |
| CN | 109185238 | B | 8/2019 |
| CN | 106015046 | B | 11/2019 |
| CN | 109236703 | B | 4/2020 |
| CN | 109737082 | B | 12/2020 |
| CN | 109737083 | B | 7/2021 |
| CN | 111441970 | B | 11/2021 |
| CN | 111102174 | B | 3/2022 |
| CN | 111075767 | B | 5/2022 |
| CN | 112524065 | B | 6/2022 |
| CN | 112283171 | B | 8/2022 |
| CN | 112727804 | B | 10/2022 |
| CN | 218493904 | U | 2/2023 |
| CN | 106895018 | B | 5/2023 |
| CN | 107120313 | B | 6/2023 |
| CN | 110778535 | B | 8/2023 |
| CN | 107575407 | B | 11/2023 |
| CN | 107965458 | B | 11/2023 |
| CN | 114794709 | B | 12/2023 |
| EP | 2990663 | B1 | 6/2017 |
| EP | 3621506 | A1 | 3/2020 |
| GB | 0717148 | | 10/2007 |
| GB | 0717151 | | 10/2007 |
| GB | 0717154 | | 10/2007 |
| GB | 2452490 | A | 3/2009 |
| GB | 2571717 | B | 12/2020 |
| GB | 2571718 | B | 12/2020 |
| GB | 2585280 | B | 5/2021 |
| GB | 2582372 | B | 8/2021 |
| GB | 2582373 | B | 8/2021 |
| GB | 2582374 | B | 8/2021 |
| GB | 2587506 | B | 3/2023 |
| GB | 2602078 | B | 7/2023 |
| JP | 5849325 | B2 | 1/2016 |
| JP | 2018162755 | A | 10/2018 |
| JP | 7025560 | B2 | 2/2022 |
| KR | 101263742 | B1 | 5/2013 |
| KR | 101979679 | B1 | 8/2019 |
| WO | 2013144555 | A3 | 1/2014 |
| WO | 2023197690 | A1 | 10/2023 |

OTHER PUBLICATIONS

U.S. Appl. No. 19/059,092, filed Feb. 20, 2025, Bladeless Fans With a Nozzle.

BLADELESS FANS WITH A NOZZLE

CROSS-REFERENCE TO RELATED APPLICATIONS

This application claims the priority of U.S. Provisional Patent Application No. 63/573,176 filed on Apr. 2, 2024, and entitled "Bladeless Fans with a Nozzle," which is hereby incorporated herein by reference in its entirety.

FIELD

The present disclosure generally relates to bladeless fans with a nozzle.

BACKGROUND

Conventional fans typically have blades that rotate about a central axis in order to produce airflow. Bladeless fans also exist and typically utilize an impeller to generate higher speed airflow. The airflow produced by conventional and bladeless fans provides a cooling effect to a user. However, the intensity of the airflow produced by typical conventional and bladeless fans is usually uneven and turbulent, which can reduce the effectiveness of the intended cooling effect. Additionally, bladeless fans typically rely on a nozzle to guide the high-speed airflow, but the typical nozzle inadequately guides the high-speed airflow and thus the high-speed airflow disperses into a multi-directional airflow pattern. Accordingly, it is desirable for a bladeless fan that overcomes these deficiencies.

SUMMARY

In general, systems, devices, and methods for bladeless fans with a nozzle are provided.

In one embodiment, a bladeless fan is provided having a base configured to be positioned on a surface. A portion of the base can be rotatable relative to the surface. The bladeless fan further includes a support rod coupled to the base and a fan arm rotatably coupled to the support rod at a connection joint. The fan arm can have first and second fan arm portions rotatably coupled to opposite sides of the connection joint. First and second airflow openings can be formed in the first and second arm portions, respectively. Rotation of an impeller within the base can generate airflow that is emitted from the fan arm.

One or more of the following features can be included in any feasible combination. For example, the portion of the base can rotate about a first axis perpendicular to the surface. In some examples, the fan arm can rotate about a second axis perpendicular to the first axis and parallel to the surface. In some examples, the first and second fan arm portions can rotate about a third axis different than the first and second axes.

In other aspects, in a first fan orientation, the fan arm can be parallel to the support rod and the third axis can be parallel to the first axis and perpendicular to the second axis. In some examples, in a second fan orientation, the fan arm can be perpendicular to the support rod and the third axis can be perpendicular to the first axis and parallel to the second axis.

In other embodiments, the support rod can be coupled to the base such that the support rod rotates together with the portion of the base. In other examples, the support rod can be movably coupled to the base such that the support rod rotates independently of the portion of the base. In some examples, the support rod can be tilted such that the support rod extends outwardly from the base at an acute angle relative to a central axis of the base. In some examples, a distance between the connection joint and the base can be adjustable.

In other aspects, at least one of movement of the base, movement of the support rod, movement of the fan arm, movement of the connection joint, and movement of the first and second fan arm portions is a motorized movement. In some examples, the bladeless fan is in wireless communication with a user device. In some examples, the motorized movement is remotely controlled via the user device.

In other embodiments, the first and second airflow openings emit air in different directions from each other. In some examples, the first and second fan arm portions can be independently moveable. In some examples, the generated airflow flows from the base into an airway of the support rod, through an airway of the connection joint, through an airway of the fan arm, and through the first and second airflow openings to be emitted from a plurality of nozzles.

In another embodiment, a bladeless fan is provided having a base, a support rod extending from the base, and a fan arm movably coupled to the support rod. The base, the support rod, and the fan arm can include a first adjustment point that allows the fan arm to be positioned in a first horizontal orientation and a second vertical orientation, a second adjustment point that allows adjustment of a radial position of the fan arm around a longitudinal axis of the support rod, and at least one additional adjustment point that allows at least one of rotational adjustment of at least a portion of the fan arm about a longitudinal axis of the fan arm and adjustment of a distance between the base and the fan arm.

In one embodiment, the at least one additional adjustment point can include a third adjustment point that allows rotational adjustment of at least a portion of the fan arm about a longitudinal axis of the fan arm. In some examples, the at least one additional adjustment point includes a fourth adjustment point configured to allow adjustment of a distance between the base and the fan arm. In some examples, the first adjustment point includes a pivot joint formed between the fan arm and the support rod. In some examples, the second adjustment point includes a rotational joint formed on at least one of the base and the support rod. In some examples, the third adjustment point includes at least one rotational joint formed on the fan arm. In some examples, the fourth adjustment point includes a sliding joint formed between the fan arm and the support rod.

In another embodiment, a bladeless fan is provided having a base with an interior having an impeller disposed therein. A support rod can extend from the base and can have an inner lumen in fluid communication with the interior of the base. A fan arm can be rotatably coupled to the support rod, and it can have first and second rotatable fan arm portions positioned on opposite ends of the fan arm. First and second nozzles can be positioned on the first and second rotatable fan arm portions, respectively. The first and second nozzles can have first and second fan lumens, respectively, in fluid communication with the inner lumen. Rotation of the impeller can be configured to generate airflow that flows into the interior of the base, through the inner lumen of the support rod, and through the first and second fan lumens to be emitted from the first and second nozzles.

One or more of the following features can be included in any feasible combination. For example, the bladeless fan can include a fluid separator coupled to the fan arm that separates the airflow generated by the rotation of the impeller into first and second airflow portions. In some examples, the first airflow portion is directed toward the first nozzle and the second airflow portion is directed toward the second nozzle. In some examples, the first and second airflow portions are independently adjustable such that an amount of airflow emitted from each of the first and second nozzles is independently adjustable. In some examples, the fluid separator deflects airflow by approximately 90 degrees as it exits the inner lumen of the support rod.

In other aspects, the first and second nozzles can be disposed within the first and second fan arm portions, respectively. In some examples, the first and second nozzles taper toward first and second nozzle openings, respectively. In some examples, the first and second nozzle openings are shaped to produce a laminar airflow. In some examples, the first and second nozzle openings include slots extending along a longitudinal axis of the fan arm. In some examples, the first and second nozzles have a teardrop-shaped cross-section, and the first and second nozzle openings are positioned along the narrowest point of the cross-section. In some examples, a direction of airflow exiting the first and second nozzle openings is normal to a surface of the fan arm housing surrounding the first and second nozzle openings.

In other embodiments, the base can include a plurality of air inlets configured to intake air into the interior of the base. In some examples, the plurality of air inlets are positioned on a removable perforated panel. In some examples, the bladeless fan includes a diffuser disposed within the interior of the base that evenly distributes air across the inner lumen of the support rod. In some examples, the diffuser is positioned downstream of the impeller and upstream of the support rod.

In yet another embodiment, a bladeless fan is provided having a base, a support arm extending from the base, and a fan arm movably coupled to the support arm and having first and second nozzles on opposed sides thereto. The first and second nozzles can be configured to emit airflow along a plane. The base, support arm, and fan arm can allow independent adjustment of an amount of airflow from each of the first and second nozzles, independent adjustment of a direction of airflow from each of the first and second nozzles, and adjustment of a position of the plane.

One or more of the following features can be included in any feasible combination. For example, the base can include an impeller that generates airflow which flows up through an inner lumen in the support arm and into first and second fan lumens in the fan arm to be emitted from the first and second nozzles. In some examples, the base includes a diffuser that evenly distributes airflow across an inner lumen of the support arm. In some examples, the bladeless fan includes a fluid separator coupled to the fan arm that directs airflow into the first and second nozzles. In some examples, the fluid separator allows independent adjustment of an amount of airflow reaching each of the first and second nozzles. In some examples, the first and second nozzles emit airflow along a first plane and a second plane, respectively, and the first plane is different from the second plane. In some examples, adjustment of a position of the plane includes a rotation of at least a portion of the fan arm relative to a longitudinal axis of the fan arm.

In another embodiment, a bladeless fan is provided having a base with an impeller disposed therein, and a support rod extending from the base. The impeller and the support rod can be axially aligned along a central axis of the base. A fan arm can be movably coupled to the support rod at a connection joint. The fan arm can have first and second fan arm portions in which first and second nozzles are disposed, respectively. The first and second nozzles can be horizontally offset from the central axis of the base. At least a portion of the connection joint can be horizontally aligned with the central axis of the base.

One or more of the following features can be included in any feasible combination. For example, a motor that rotates the impeller can be disposed within the base. The motor can be axially aligned with the impeller along the central axis of the base. In some examples, a diffuser that evenly distributes airflow is disposed within the base, the diffuser being axially aligned with the impeller along the central axis of the base.

In some embodiments, the support rod can be connected to the base at a first end and can extend outwardly therefrom along the central axis of the base, terminating at a second end opposite of the first end. In some examples, a distance between the first and second ends of the support rod is longer than a distance between the connection joint and an end of the fan arm. In some examples, a distance between the first and second ends of the support rod is longer than a maximum length of the first fan arm portion or the second fan arm portion. In some examples, a distance between the first and second ends of the support rod is longer than half of a total length of the fan arm. In some examples, a distance between the first and second ends of the support rod is longer than a distance between a surface on which the base is positioned and the first end of the support rod. In some examples, the connection joint is movable between the first and second ends of the support rod.

In other aspects, the support rod can include an inner lumen. In some examples, first and second fan lumens in fluid communication are formed in the first and second nozzles, respectively. In some examples, a maximum circumference of the inner lumen is greater than a maximum circumference of the first and second fan lumens. In some examples, the connection joint includes a branched airway in fluid communication with the inner lumen and the first and second fan lumens. In some examples, a maximum circumference of the branched airway is equal to a maximum circumference of the inner lumen. In some examples, a minimum circumference of the branched airway is equal to a maximum circumference of the first and second fan lumens.

In another embodiment, a bladeless fan is provided having a base with an impeller therein. An elongate support can extend from the base and can have an inner lumen that receives airflow from the impeller. A fan arm can be movably coupled to the base and can have first and second fan arm portions positioned on opposite sides thereof that receive airflow flowing through the inner lumen in the elongate support. The fan arm can extend along a longitudinal axis that is offset from a longitudinal axis of the elongate support and a longitudinal axis of the base.

One or more of the following features can be included in any feasible combination. For example, the fan arm can have a length that is about two times greater than a length of the elongate support. In some examples, the fan arm has a length that is about three times greater than a length of the base. In some examples, the elongate support is adjustable in length such that a length of the elongate support is between about 50 percent and about 100 percent of a length of the fan arm. In some examples, the first and second fan arm portions each include a nozzle opening, each nozzle opening having a length that is about 90 percent of a length of the respective fan arm portion. In some examples, a maximum diameter of the inner lumen is approximately two times greater than a maximum diameter of first or second fan lumens formed within the first or second fan arm portions, respectively. In some examples, a length of the elongate support is about five times greater than a maximum diameter of the inner lumen of the elongate support.

BRIEF DESCRIPTION OF DRAWINGS

This disclosure will be more fully understood from the following detailed description taken in conjunction with the accompanying drawings, in which.

DETAILED DESCRIPTION

Figure 1B:
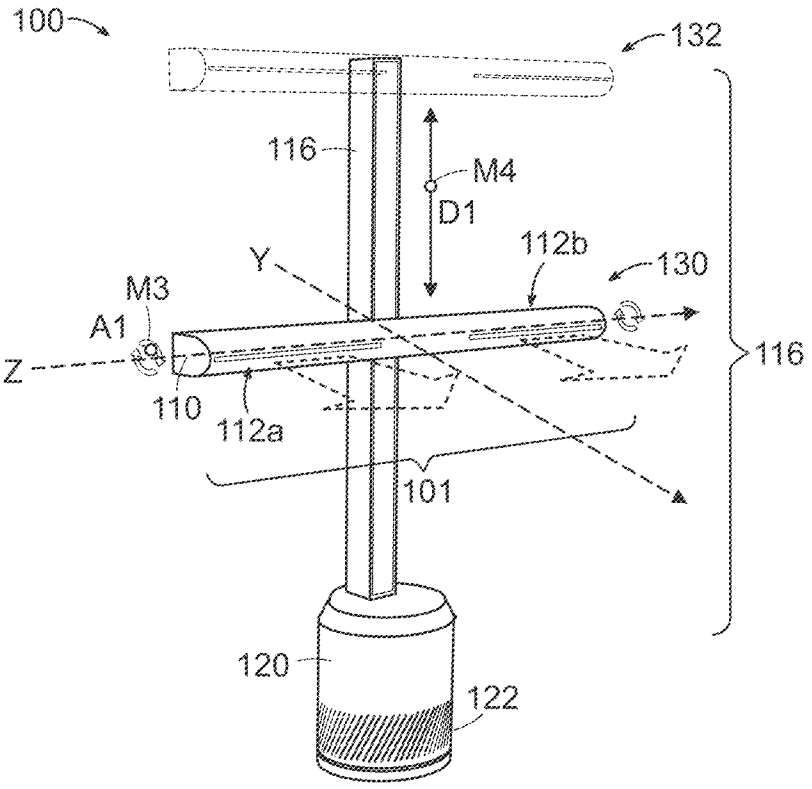
FIG. 1B is another perspective view of the bladeless fan of FIG. 1A.

Certain embodiments will now be described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting embodiments and that the scope of the present invention is defined solely by the claims. The features illustrated or described in connection with one embodiment can be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

As discussed previously, flow produced by typical conventional and bladeless fans is usually uneven and turbulent, which can reduce the effectiveness of the intended cooling effect. Additionally, bladeless fans typically rely on a nozzle to guide the high-speed airflow, but the typical nozzle inadequately guides the high-speed airflow and thus the high-speed airflow disperses into a multi-directional airflow pattern. To address these limitations, provided herein are various systems, devices, and methods for bladeless fans are provided herein with improved layouts and nozzle designs. The bladeless fans provided herein contain a nozzle that produces smooth, high-speed airflow in a single-directional flow pattern. Further, the bladeless fans described herein are highly adjustable, allowing for users to adjust airflow from each nozzle in any direction of the user's choosing, thereby providing targeted airflow to the precise areas that require cooling.

In general, a bladeless fan can include a fan arm with a fan arm housing. One or more fan arm portions can be coupled to the fan arm housing, each fan arm portion having at least one nozzle that can emit high speed airflow and thus provide a cooling effect to a user. The nozzle can emit the airflow in a single direction. The airflow may be generated by an impeller of the bladeless fan, with the impeller being powered by a motor. The impeller can be in fluid communication with a diffuser, such that the airflow generated by the impeller can flow through a fluid flow path defined by the diffuser. The diffuser can be fluidically connected to a fluid conduit (e.g., lumen) of a support rod. The diffuser can evenly distribute air across the fluid conduit of the support rod. The air can flow through the fluid conduit of the support rod and through the fan arm. The fan arm, which can be hollow, can further define one or more fluid flow paths, such that the airflow can be evenly distributed throughout the fan arm housing and nozzle(s). Each nozzle can define a fluid outlet that emits the airflow. The nozzle can be shaped such that the emitted airflow can be focused on a single direction. Additionally, the fan arm can be shaped such that the airflow can be uniformly distributed along a length of the nozzle, such that the volume and/or velocity of the emitted air therefrom is substantially uniform. The fan arms and nozzles described herein can be configured to adjust the direction of the airflow. For example, the fan arm can be movably coupled to the support rod, such that the fan arm can be positioned in multiple locations and/or orientations relative to the support rod. In any of the locations and/or orientations described herein, the air emitted by the nozzles can be substantially uniform and focused in a single direction.

The bladeless fans described herein are adjustable at multiple points so as to allow airflow from each nozzle to be emitted in any direction of the user's choosing, thereby providing targeted airflow to the precise areas that require cooling. In general, a bladeless fan can include a base which contains the impeller, diffuser, and motor described above. The base can be placed on a surface and rotate about a first axis perpendicular to the surface. The support rod described above can be connected to the base and extend outwardly therefrom. The fan arm described above can be movably coupled to the support rod and rotate about a second axis perpendicular to the first axis. The one or more fan arm portions described above can rotate about a third axis different from the first and second axes. Further, each fan arm portion can be independently adjusted from one another so that each nozzle points in a desired direction of the user's choosing.

FIGS. 1A-1D illustrate one embodiment of a bladeless fan 100 that includes a base 120 and a fan arm 101 having a fan arm housing 110. The base 120 can be positioned on a surface and can rotate about a first axis X perpendicular to the surface. The first axis X can be a central axis of the base 120 that is approximately in the middle of the base 120. In some embodiments, a bottom portion of the base 120 that makes contact with the surface does not rotate relative to the surface. Instead, a top portion of the base 120 may be rotatably connected to the bottom portion of the base 120 such that the top portion of the base 120 rotates about the first axis X relative to both the surface and the bottom portion of the base 120. The base 120 includes a plurality of fluid inlets 122 that receive air from an external environment. Positioned within an interior of the base 120 is an impeller and a motor (obscured in the figures). The impeller rotates in order to generate high-speed airflow. The impeller is in fluid communication with a diffuser (obscured in the figures) and an inner lumen (e.g., a fluid conduit) of a support rod 116 coupled to the base 120. As will be described herein, rotation of the impeller within the base 120 can generate airflow that flows from the inlets 122 of the base 120 into the support rod 116, through the fan arm 101, and out of the nozzle openings 112*a*, 112*b* on the fan arm housing 110.

In some embodiments, the support rod 116 can be coupled to the base 120 at a first end and extend outwardly therefrom. A second end of the support rod 116 can be located opposite of the first end (e.g., extending vertically from the first end such that the support rod 116 is approximately vertical relative to the surface on which the base 120 is positioned). The fan arm housing 110 is movably connected to a connection joint along the length of the support rod 116. The support rod 116 can be long enough to allow the fan arm 101 to be coupled at a sufficient distance above the surface so as to rotate freely without hitting the surface. In some embodiments, a distance between the first and second ends of the support rod 116 can be longer than a distance between the connection joint and one end of the fan arm housing 110. In some embodiments, the distance between the first and second ends of the support rod 116 can be longer than half the length of the overall fan arm housing 110.

Figure 2B:
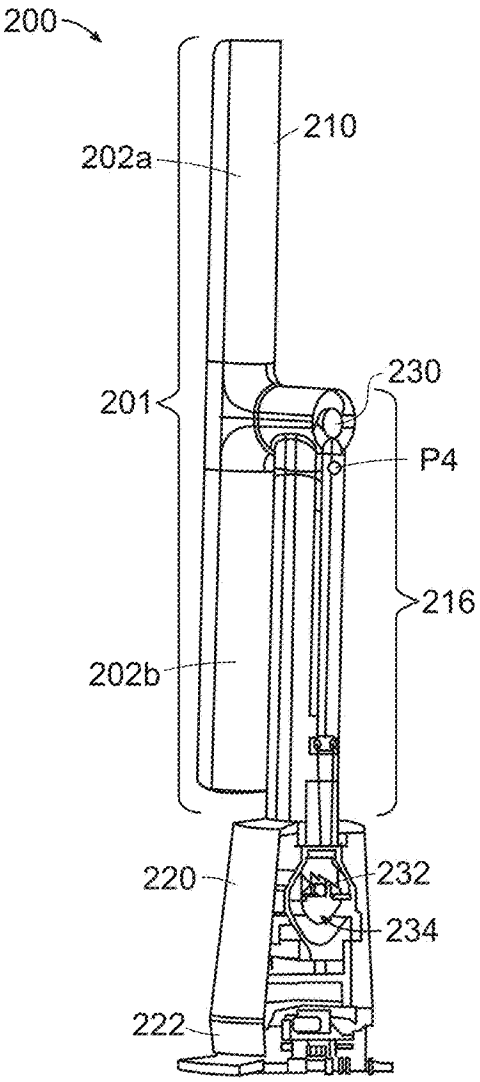
FIG. 2B is another cross-sectional view of the bladeless fan of FIG. 2A.
Figure 2A:
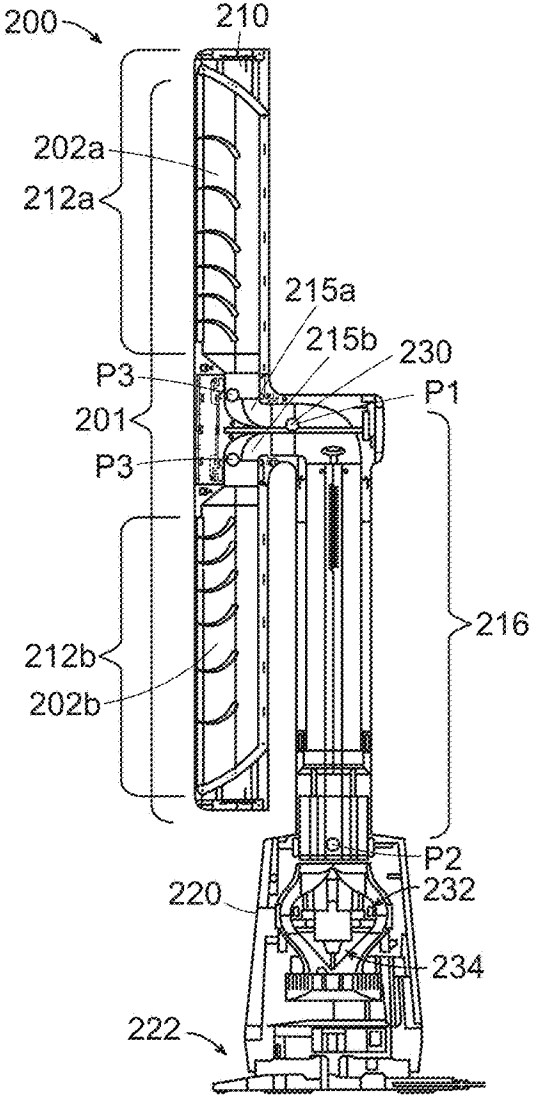
FIG. 2A is a cross-sectional view of another embodiment of a bladeless fan.

The support rod 116 can rotate along the same axis, the first axis X, as the base 120. In some embodiments, the support rod 116 can be axially aligned with the motor of the base 120 along a central axis of the base 120 (e.g., the first axis X). However, the support rod 116 need not be axially aligned with either the motor or the central axis of the base (as shown in FIGS. 2A-2B, which depict a support rod 216 offset from the central axis of the base 220). In some embodiments, the support rod 116 can be movably coupled to the base 120 such that the support rod 116 can rotate independently of the base 120, e.g., about a parallel axis to the first axis X. Air that enters the bladeless fan 100 via the fluid inlets 122 can pass through the impeller and diffuser of the base 120 and into the inner lumen of the support rod 116, which is in fluid communication with the interior of the base 120. Further, the inner lumen of the support rod 116 is in fluid communication with one or more fluid flow paths (obscured in the figures) positioned in the fan arm housing 110 of the fan arm 101. For example, the inner lumen of the support rod 116 can connect to one or more airflow openings (obscured in the figures) inside of the fan arm housing 110 that direct airflow out toward one or more nozzle openings 112*a*, 112*b* on the fan arm housing 110.

In some embodiments, the fan arm 101 is connected to the support rod 116 at a connection joint (e.g., connection joint 230, which will be discussed further below with respect to FIGS. 2A-2B). The one or more airflow openings can be located on opposite sides of the connection joint. The connection joint can enable rotation, translation, and/or tilting of the fan arm 101 relative to the support rod 116.

Figure 1A:
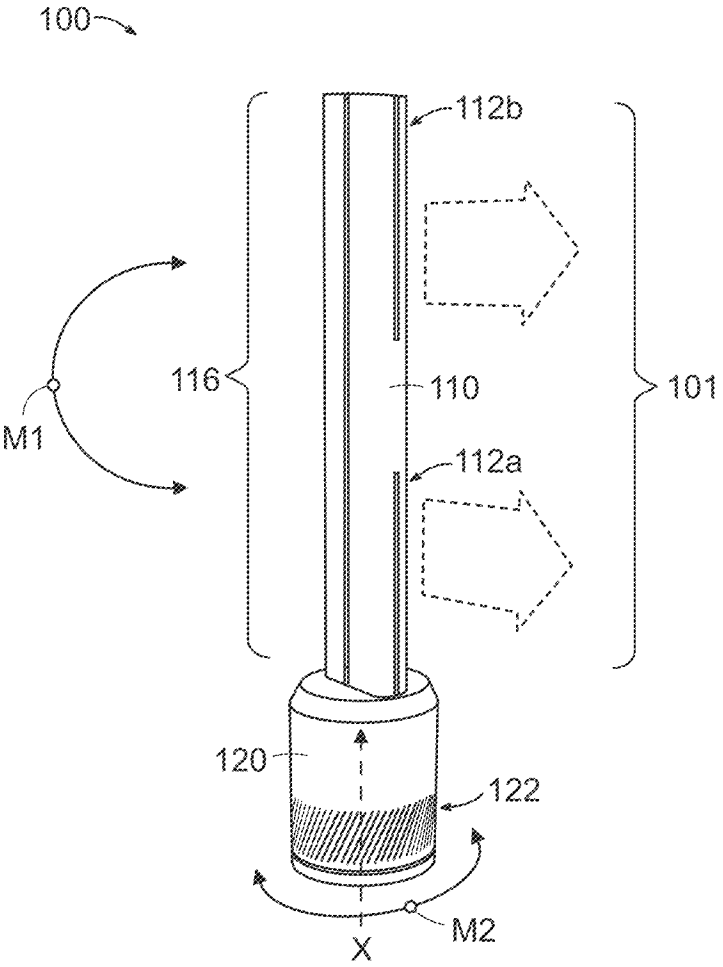
FIG. 1A is a perspective view of an embodiment of a bladeless fan.

In some embodiments, the fan arm 101 can be rotated around a second axis Y. The second axis Y can be perpendicular to the first axis X. For example, as shown in FIGS. 1A-1B, the fan arm 101 can be movably coupled to the support rod 116 such that it can have one or more configurations. As shown in FIG. 1A, the fan arm 101 has a first configuration such that a dominant dimension (e.g., length) of the fan arm housing 110 is parallel with the support rod 116. In the first configuration, a first end of the fan arm housing 110 is positioned adjacent the base 120 and a second end of the fan arm housing 110 is positioned adjacent a second of the support rod 116. As shown in FIG. 1B, the fan arm 101 has a second configuration such that the dominant dimension of the fan arm housing 110 is perpendicular to the support rod 116. A user can easily rotate the fan arm housing 110 between the first and second configurations. In particular, the fan arm housing 110 is coupled to the support rod 116 by a connection joint comprising an axle (obscured in the figures) that defines the second axis Y of rotation, with the axle being positioned at a midpoint along the dominant dimension of the fan arm housing 110. In alternative embodiments, the axle can be positioned at any point along the dominant dimension of the fan arm housing 110. In some embodiments, the fan arm housing 110 can rotate between about 0 degrees and about 90 degrees about the second axis Y defined by the axle. In some embodiments, the fan arm housing 110 can freely rotate clockwise and/or counter-clockwise around the connection joint by 360+ degrees in each direction.

Additionally, the fan arm housing 110 can be moved translationally along a dominant dimension of the support rod 116. For example, as shown in FIG. 1B, the fan arm housing 110 can be positioned in a first position 130 or a second position 132. The first position 130 corresponds to a first distance relative to the base 120 and the second position 132 corresponds to a second distance relative to the base 120, with the second distance being greater than the first distance. A distance, DI, between the first and second positions 130, 132 can be equal to or less than the dominant dimension of the support rod 116. For example, it is within the scope of this disclosure for the first and second positions 130, 132 to be at any point along the support rod 116. In some embodiments, the fan arm housing 110 can translate along the dominant direction of the support rod 116 such that the fan arm housing 110 is moved closer to and/or further from the base 120. For example, the distance between the connection joint and the base 120 can change when the fan arm housing 110 is translated along the support rod 116. In some embodiments, the support rod 116 can telescope toward and/or away from the base 120 such that the fan arm housing 110 is moved closer to and/or further from the base 120. For example, the distance between the connection joint and the base 120 can change when the support rod 116 is telescoped relative to the base 120.

Furthermore, the fan arm housing 110 can be tilted relative to the support rod 116. For example, as shown in FIG. 1B, the fan arm housing 110 can be tilted by an angle A1 along a third axis Z different from the first axis X and/or the second axis Y. The angle A1 can be between about 0 degrees and about 180 degrees relative to the dominant dimension of the support rod 116. For example, with the fan arm housing 110 positioned at about 0 degrees, the nozzle openings 112*a*, 112*b* can be directed towards the base 120, whereas with the fan arm housing 110 positioned at about 180 degrees, the nozzle openings 112*a*, 112*b* can be directed away from base 120. The magnitude of the angle A1 can be easily adjusted by the user, which advantageously allows the fan arm housing 110 to emit airflow in a desired direction. At any angle of A1, the nozzle openings 112*a*, 112*b* can be oriented relative to the fan arm housing 110 such that airflow exiting the nozzle openings 112*a*, 112*b* is normal to the surface of the fan arm housing 110 surrounding the nozzle openings 112*a*, 112*b*.

In some embodiments, such as shown in FIGS. 1A-1B, the fan arm housing 110 includes a first fan arm portion with a first nozzle that defines a first nozzle opening 112*a* and a second fan arm portion with a second nozzle that defines a second opening 112*b*. The first and second fan arm portions may be movably coupled to the fan arm housing 110 such that they can rotate relative to the support rod 116, e.g., about the third axis Z. Each arm portion can include an airflow opening that receives airflow from the inner lumen of the support rod 116 via the connection joint, an internal fluid flow path that carries airflow within the respective arm portion, and a nozzle opening (e.g., 112*a*, 112*b*) that expels airflow from the arm portion. In some embodiments, the fan arm housing 110 can include first and second airflow openings each configured to intake air for their respective arm portion. The first and second airflow openings can expel air in different directions from each other (e.g., the first airflow opening expels air in a first direction to reach the first nozzle opening 112*a*, and the second airflow opening expels in a second direction to reach the second nozzle opening 112*b*). Further, the first and second fan arm portions may be independently actuable such that the angle of rotation of the first fan arm portion about the third axis Z is not the same as the angle of rotation of the second fan arm portion about the third axis Z. The independent actuation of the first an second fan arm portions means that the first and second nozzle openings can expel air in different directions from each other (e.g., the first nozzle opening expels air in a first direction, and the second nozzle opening expels in a second direction).

Each of the first and second nozzle openings 112*a*, 112*b* can emit the airflow supplied by the impeller. The first and second nozzle openings 112*a*, 112*b* are formed as slots that extend along a dominant dimension of the respective fan arm portion. For example, the first and second nozzle openings 112*a*, 112*b* each have a length and a width, with the length being greater than the width. The width of each of the first and second nozzle openings 112*a*, 112*b* is minimized to help facilitate unidirectional, high-speed airflow therefrom. Additionally, the length and width of the first and second nozzle openings 112*a*, 112*b* further facilitate fully developed airflow with minimal turbulence in the airflow prior to exiting the first and second nozzle openings 112*a*, 112*b*. For example, the airflow emitted via the first and second nozzle openings 112*a*, 112*b* has relatively lower fluctuations in the flow than comparable openings that have a shorter length and/or greater width.

In some embodiments, the first and second nozzle openings 112*a*, 112*b* may be horizontally offset from the central axis of the base 120 (e.g., the first axis X). For example, as shown in FIGS. 1A-1B, the nozzle openings 112*a*, 112*b* are horizontally offset in the direction of the second axis Y such that there is a horizontal distance between the center of the base 120 and the nozzle openings 112*a*, 112*b*. Thus, in some embodiments, there is a horizontal distance between the air intake (e.g., the inlets 122 of the base 120) and the air outlets (e.g., the nozzle openings 112*a*, 112*b*) of the bladeless fan 100. Further, in some embodiments, the connection joint (e.g., connection joint 230 of FIGS. 2A-2B) may be horizontally offset from one or both the nozzle openings 112*a*, 112*b* and the central axis of the base 120. In other embodiments, the connection joint may be horizontally aligned with the central axis of the base 120.

While the embodiment shown has two openings, it is within the scope of the disclosure herein for a bladeless fan 100 to have one opening or more than two openings (e.g., three, four, five, or more). Additionally or alternatively, the bladeless fans 100 described herein can include multiples of various components, such as multiple fan arm housings 110, multiple fan arms 101 with multiple fan arm portions, multiple support rods, multiple bases, or any combination thereof.

Figure 1D:
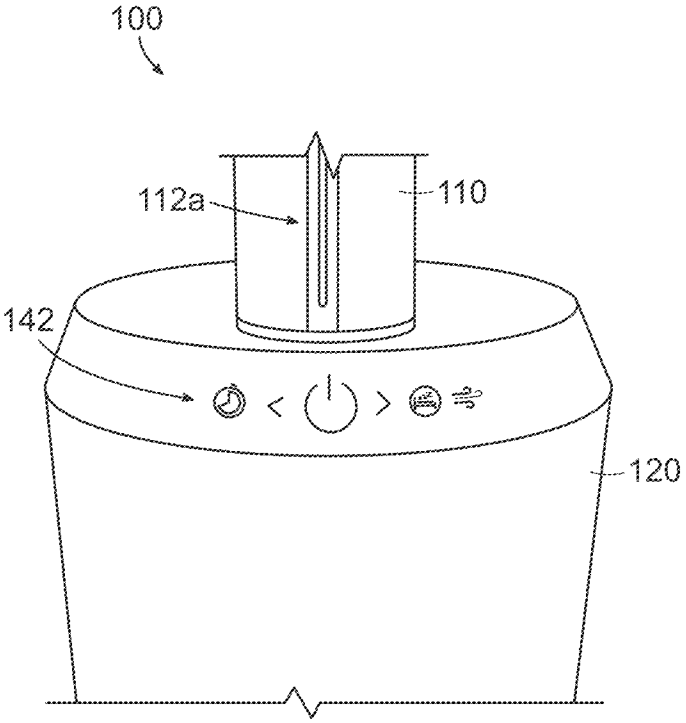
FIG. 1D is a front view of another portion of the bladeless fan of FIG. 1A.
Figure 1C:
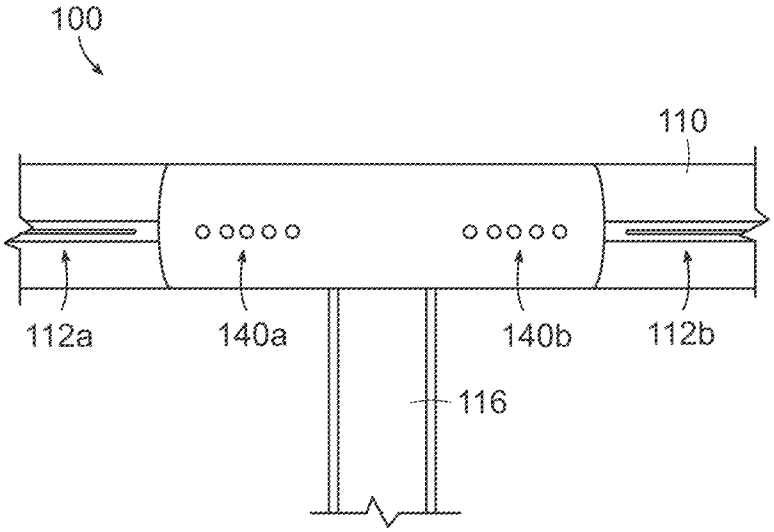
FIG. 1C is a front view of a portion of the bladeless fan of FIG. 1A.

The bladeless fan 100 can include one or more electronic components that improve the accessibility of the bladeless fan 100. As shown in FIGS. 1C and 1D, the bladeless fan 100 includes status indicators 140*a*, 140*b* and a user interface 142. For example, the fan arm housing 110 includes a first status indicator 140*a* and a second status indicator 140*b*. The first and second status indicators 140*a*, 140*b* can indicate a status of the corresponding fan arm. For example, each of the first and second status indicators 140*a*, 140*b* are a plurality of lights that can emit light in accordance with a magnitude (e.g., velocity, volume) of the airflow being emitted through an opening of the respective fan arm. In an embodiment, a greater magnitude of airflow through the first nozzle opening 112*a* corresponds to the first status indicator 140*a* emitting brighter light and/or more lights thereof being activated. The second status indicator 140*b* operates in a similar manner. Additionally, the base 120 further includes a user interface 142. The user interface 142 can receive an input from a user in order to control the operation of the bladeless fan 100. For example, the user interface 142 can allow the user to control one or more of a power status, an air temperature, a configuration selection, a fan arm housing position, an operation mode, a timing function, an airflow velocity, and an airflow magnitude. The user interface 142 and/or status indicators 140*a*, 140*b* can be combined with any of the embodiments of the bladeless fans described herein.

In some embodiments, adjustments to the components of the bladeless fan 100 can be motorized and/or automated. For example, adjustment of the base 120 via rotation of the base about the first axis X and adjustment of the fan arm 101 via rotation of the fan arm 101 about the second axis Y, translation of the connection joint along the support rod 116, and/or rotation of the fan arm portions about the third axis Z can be performed using a motor and/or actuator. This motorized movement may be performed automatically based upon a predetermined fan setting and/or in response to a user's command. In some embodiments, the user's command may be manually inputted by the user (e.g., via the user interface 142) and/or issued remotely, such as via a remote user device that is in wireless communication with the bladeless fan 100. The adjustments to the components of the bladeless fan 100 are labeled in FIGS. 1A-1B. Movement M1 is the rotation of the fan arm 101 about the second axis Y. Movement M2 is the rotation of the base about the first axis X. Movement M3 is the rotation of the fan arm portions about the third axis Z. Movement M4 is the translation of the fan arm 101 along the longitudinal axis of the support rod 116. The various joints and adjustment points (e.g., points P1-P4 of FIGS. 2A-2B) that enable the movements M1-M4 are described in greater detail in the later figures.

FIGS. 2A-2B illustrate another embodiment of a bladeless fan 200 that includes a connection joint 230, a first fan arm portion 202*a*, and a second fan arm portion 202*b*. While the embodiment shown in FIGS. 2A-2B has two fan arm portions 202*a*, 202*b*, it is within the scope of the disclosure herein for a bladeless fan to have one fan arm portion or more than two fan arm portions (e.g., three, four, five, or more).

The bladeless fan 200 in this illustrated embodiment is generally configured and used similar to the bladeless fan 100 of FIGS. 1A-1D. FIG. 2A illustrates a cross-sectional view of the bladeless fan 200 that shows the internal airways of the bladeless fan 200. As shown, the bladeless fan 200 includes a fan arm 201 having a fan arm housing 210 that houses the fan arm portions 202*a*, 202*b*, a support rod 216, a connection joint 230 that connects the fan arm 201 to one end of the support rod 216, and a base 220 connected to the other end of the support rod 216, the interior of the base 220 containing an impeller 234 and a diffuser 232 to generate airflow within the bladeless fan 200. In an example, the fan arm 201 can be positioned at a lower end of the support rod 216, such that the fan arm 201 is positioned at a first distance from the base 220. As another example, the fan arm 201 can be positioned at an upper end of the support rod 216, such that the fan arm 201 is positioned at a second distance from the base 220. The fan arm 201 can also be positioned at any position between the upper and lower ends of the support rod 216. FIGS. 2A-2C show the fan arm 201 in a first configuration, similar to the first configuration described with reference to FIG. 1A. In the first configuration, the fan arm 201 is parallel to the support rod 216. FIG. 2D shows the fan arm 201 in a second configuration, similar to the second configuration described with reference to FIG. 1B. In the second configuration, the fan arm 201 is perpendicular to the support rod 216.

As shown in FIGS. 2A-2B, one or more nozzles are disposed within the fan arm housing 210 such that at least a first nozzle is disposed inside the first fan arm portion 202*a* and at least a second nozzle is disposed inside the second fan arm portion 202*b*. The nozzles can include airflow openings 215*a*, 215*b* that can couple to the connection joint 230 and nozzle openings 212*a*, 212*b* that can emit airflow. For each fan arm portion 202*a*, 202*b*, the airflow openings 215*a*, 215*b* can be in fluid communication with the respective nozzle openings 212*a*, 212*b* via hollow fan lumens forming one or more fluid flow paths between the airflow openings 215*a*, 215*b* and the nozzle openings 212*a*, 212*b*. The fan lumens can be in fluid communication with the inner lumen of the support rod via the airflow openings 215*a*, 215*b* and the connection joint 230. For example, airflow generated by the rotation of the impeller 234 can flow through the inner lumen of the support rod 216, the first and second airflow openings 215*a*, 215*b*, and the first and second fan lumens of the first and second fan nozzles to be emitted from the first and second nozzle openings 212*a*, 212*b*.

As described previously, the fan arm portions 202*a*, 202*b* each include a nozzle opening. As shown, the first fan arm portion 202*a* includes a first nozzle opening 212*a* and the second fan arm portion 202*b* includes a second nozzle opening 212*b*. The first and second nozzle openings 212*a*, 212*b* have generally similar structure as the nozzle openings 112*a*, 112*b* described with reference to FIGS. 1A-1D, such that the direction of airflow exiting the nozzle openings 212*a*, 212*b* is approximately normal to the surface of the fan arm housing 210 surrounding the nozzle openings 212*a*, 212*b*. The fan arm portions 202*a*, 202*b* can receive fluid (e.g., air) via a connection joint coupled to an internal lumen that is positioned within the support rod 216. In some embodiments, the fan arm portions 202*a*, 202*b* are positioned at opposite ends of the fan arm 201 and/or coupled to opposite sides of the connection point 230.

The connection joint 230 serves to both physically and fluidly connect the fan arm 201 to the support rod 216. As described previously, the connection joint 230 allows for movable connections between the fan arm 201 and the support rod 216. In some embodiments, the connection joint 230 may include a fluid separator. In some embodiments, the fluid separator includes two conduits that can separate the airflow generated by the rotation of the impeller into two airflow portions. A first conduit of the fluid separator directs a first airflow portion toward the nozzle of the first fan arm portion 202*a*. A second conduit of the fluid separator directs a second airflow portion toward the nozzle of the second fan arm portion 202*b*. In some embodiments, the fluid separator includes a branched airway that branches into the first conduit and the second conduit. The branched airway is in fluid communication with the inner lumen of the support rod 216 and fan lumens of the fan arm portions 202*a*, 202*b*. In some embodiments, a maximum circumference of the branched airway is equal to a maximum circumference of the inner lumen. In some embodiments, a minimum circumference of the branched airway is equal to a maximum circumference of the first and second fan lumens. One or more apertures, valves, or other flow limiters may be installed within each conduit and/or the branched airway of the fluid separator to control the amount of airflow into each of the fan arm portions 202*a*, 202*b*. By adjusting the flow limiters independently, the amount of air in the first airflow portion and the amount of air in the second airflow portion can be independently adjusted. Thus, the amount of air exiting each nozzle is likewise independently adjustable.

The connection joint 230 is one of many adjustment points that enable various adjustments of the bladeless fan 200. For example, movements M1-M4, as described with respect to FIGS. 1A-1B, can be performed at the adjustment points. As shown in FIGS. 2A-2B, the bladeless fan 200 has at least four adjustment points P1, P2, P3, and P4. Adjustment point P1 corresponds to the connection point 230 and is located between the fan arm 201 and the support rod 216. Point P1 allows the fan arm 201 to be positioned in a vertical orientation (e.g., the orientation shown in FIG. 1A), a horizontal orientation (e.g., the orientation shown in FIG. 1B), and any orientation in-between. In some embodiments, P1 includes a rotatable joint and/or a pivot joint formed between the fan arm 201 and the support rod 216. Point P2 is located between the support rod 216 and the base 220. Point P2 allows the radial position of the fan arm 201 to be adjusted relative to an axis, such as the longitudinal axis of the support rod 216. For example, the rotation of the base 220 and/or the support rod 216 at point P2 allows the fan arm 201 to rotate relative to the central axis of the base 220 and/or the support rod 216. In some embodiments, point P2 is a rotational joint formed on at least one of the base 220 and/or the support rod 216. Points P3 are located between the fan arm portions 202*a*, 202*b* and the fan arm housing 210. Each point P3 allows the rotational adjustment of the respective fan arm portion 202*a*, 202*b* relative to an axis, such as the longitudinal axis of the fan arm 201 and/or the fan arm housing 210. For example, the rotation of the fan arm portion 202*a* at a point P3 allows the fan arm portion 202*a* to rotate relative to the central axis of the fan arm housing 210. In some embodiments, points P3 includes at least one rotational joint formed on the fan arm 201. Point P4 is located within the fan arm 201 and/or the support rod 216. Point P4 allows for a distance between the base 220 and the fan arm 201 to be adjusted. For example, the fan arm 201 can be connected to the support rod 216 at a point P4 such that the fan arm 201 can move up and down along the longitudinal axis of the support rod 216. In some embodiments, point P4 includes a sliding joint formed between the fan arm 201 and the support rod 216. In some embodiments, point P1 and point P4 are combined. For example, the connection joint 230 between the fan arm 201 and the support rod 216 can form both point P1 and P4, such that connection joint 230 allows for both rotational movement (of the fan arm 201 relative to the central axis of the support rod 216) and translation movement (of the fan arm 201 along the central axis of the support rod 216). In some embodiments, the distance between the connection joint 230 and the base 220 is adjustable.

Figure 2E:
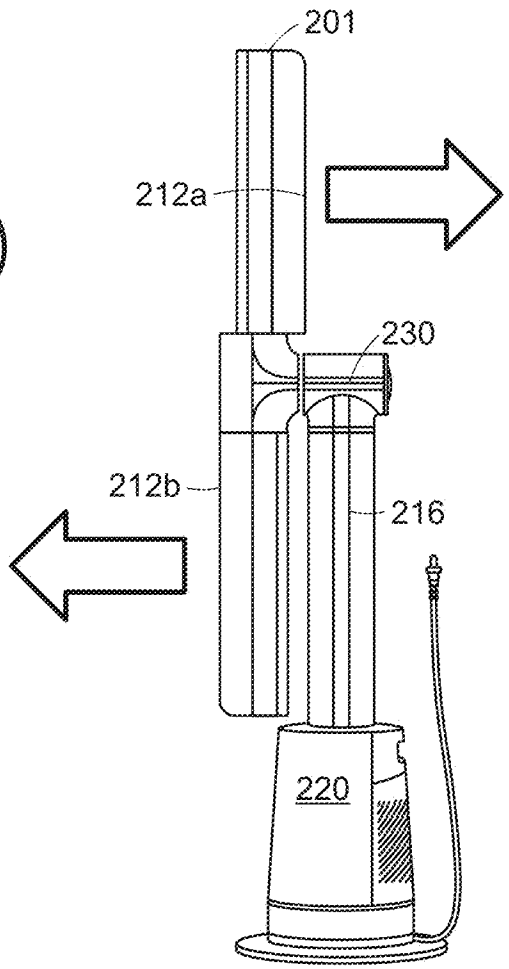
FIG. 2E is a perspective view of the bladeless fan of FIG. 2A in yet another configuration.
Figure 2D:
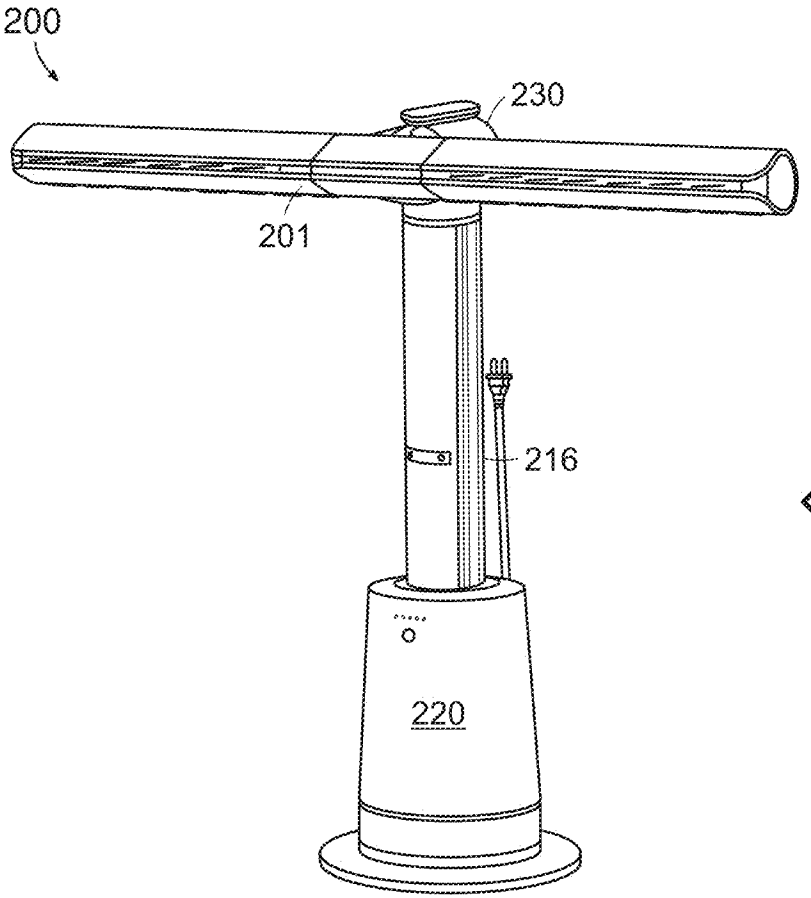
FIG. 2D is a perspective view of the bladeless fan of FIG. 2A in another configuration.
Figure 2C:
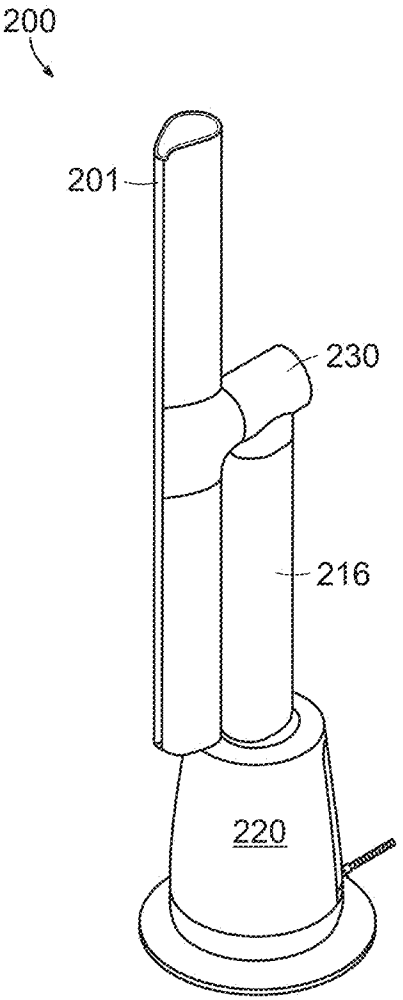
FIG. 2C is a perspective view of the bladeless fan of FIG. 2A in one configuration.

FIG. 2E illustrates the rotation of the fan arm portions 202*a*, 202*b* at the points P3 in greater detail. The points P3 are located at the airflow openings 215*a*, 215*b*. As shown in FIG. 2E, the fan arm portions 202*a*, 202*b* are independently moveable. Moving the fan arm portions 202*a*, 202*b* relative to the longitudinal axis of the fan arm 201 can allow the fan arm portions 202*a*, 202*b* to emit airflow in different directions. For example, the fan arm portions 202*a*, 202*b* can be rotated relative to the support arm such that the nozzle openings 212*a*, 212*b* emit airflow from different planes. The first nozzle opening 212*a* can emit airflow along a different plane than the second nozzle opening 212*b*.

Figure 2G:
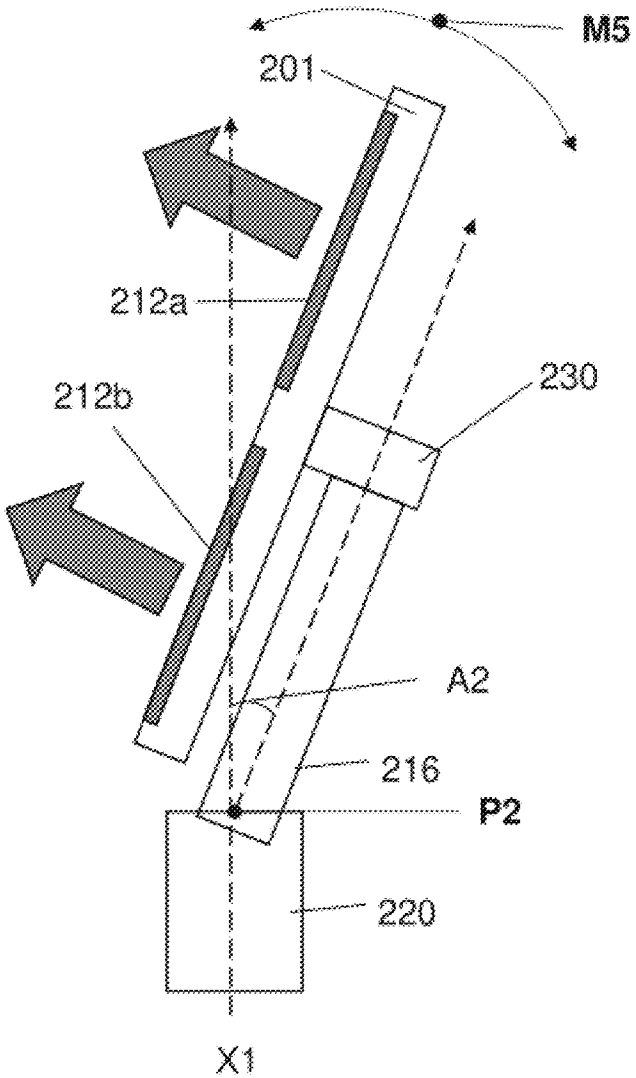
FIG. 2G is a schematic drawing of the bladeless fan of FIG. 2A in a tilted configuration.
Figure 2F:
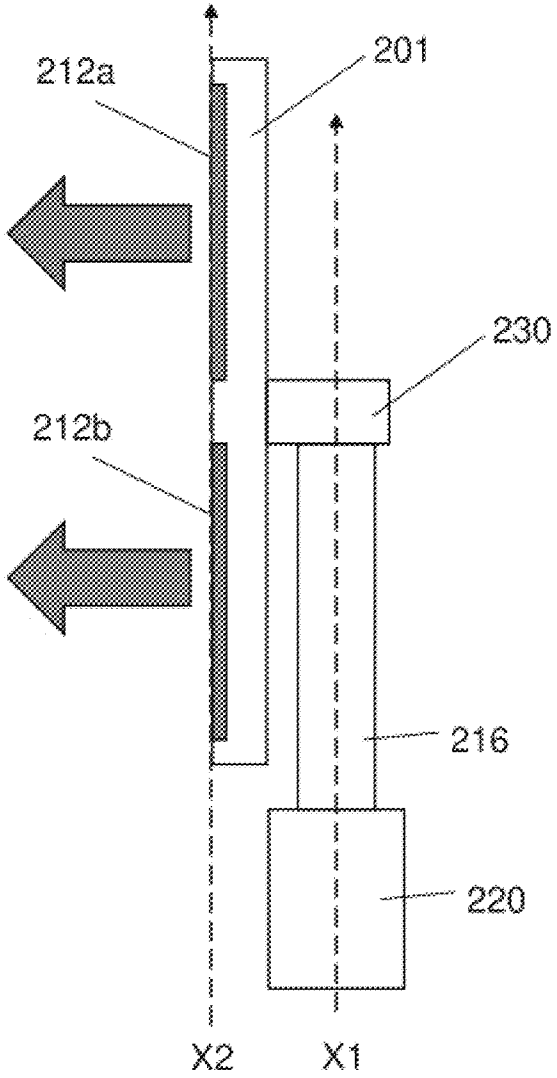
FIG. 2F is a schematic drawing of the bladeless fan of FIG. 2A in an upright configuration.

FIGS. 2F-2G illustrate embodiments of the bladeless fan 200 in which the support rod 216 is vertical or tilted. FIG. 2F is a schematic diagram of the bladeless fan 200 in a vertical configuration in which the support rod 216 is oriented vertically, such that the support rod 216 is parallel to and axially aligned with a central axis X1 running through the base 220. In some embodiments, the central axis X1 is substantially orthogonal to the surface on which the fan arm 200 is placed. As shown in FIG. 2F, the nozzle openings 212*a* and 212*b*, which are aligned along an axis X2, are horizontally offset from the central axis X2 of the base. The connection joint 230, or at least a portion thereof, is horizontally aligned with the central axis X1. Although not pictured in FIG. 2F, in some embodiments, the motor, diffuser, and/or the impeller are also axially aligned with the central axis X1 of the base.

In some embodiments, the support rod 216 is tiltable such that the support rod 216 extends outwardly from the base 220 at an acute angle relative to the central axis X1 of the base. As shown in FIG. 2E, the support rod 216 can be tilted at an angle A2 relative to the central axis X1. The joint at which the support rod 216 and the base 220 can include a pivot joint that enables the tilting of the support rod 216. Point P2 can enable the movement M5, which is the tilting of the support rod 216 relative to the central axis X1, in addition to the movement M2, which is the adjustment of the radial position of the support rod 216 around the central axis X1.

Figure 3C:
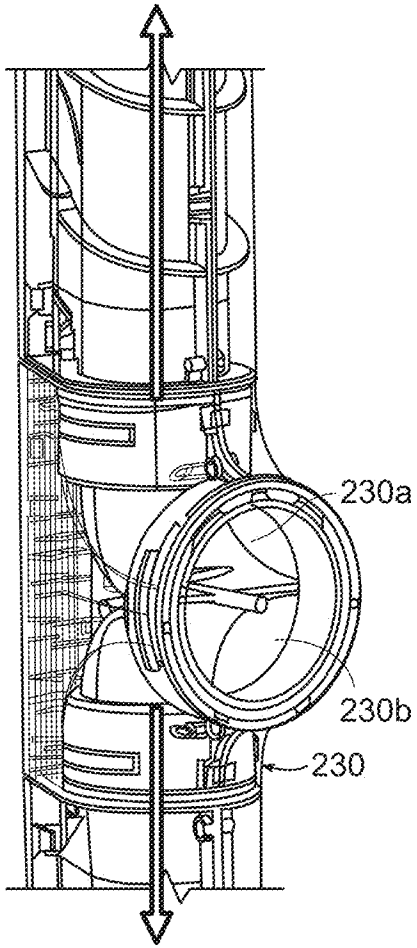
FIG. 3C is yet another cross-sectional view of another portion of the bladeless fan of FIG. 2A.
Figure 3B:
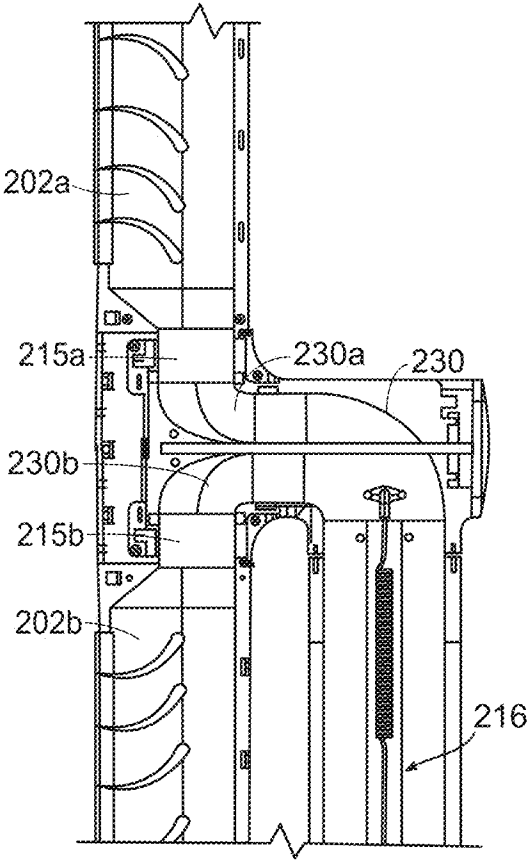
FIG. 3B is another cross-sectional view of another portion of the bladeless fan of FIG. 2A.
Figure 3A:
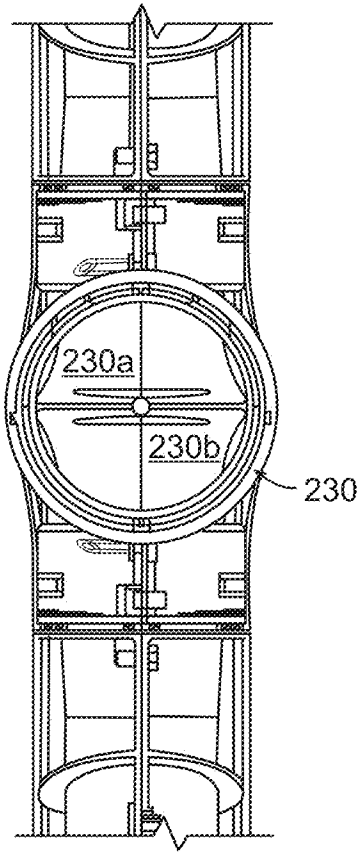
FIG. 3A is a cross-sectional view of a portion of the bladeless fan of FIG. 2A.

In some embodiments, the fluid separator of the connection joint 230 can evenly divide the airflow coming from the inner lumen of the support arm 216 between the first fan arm portion 202*a* and the second fan arm portion 202*b*. For example, as seen in FIGS. 3A-3C, the connection joint 230 includes a first fluid conduit portion 230*a* and a second fluid conduit portion 230*b*. As shown in FIG. 3B, the first fluid conduit 230*a* is coupled to the first fan arm portion 202*a* via the first airflow opening 215*a*, such that a fluid flow path therebetween is formed. The second fluid conduit 230*b* is coupled to the second fluid conduit 230*b* via the second airflow opening 215*b* in a similar manner. The fluid conduits 230*a*, 230*b* can evenly spread air pressure along an internal volume defined by the hollow fan arm portions 202*a*, 202*b* (e.g., a fan lumen 314*a*, as described further herein). The internal volumes of the fan arm portions 202*a*, 202*b* thus create a plenum within the fan arm portions 202*a*, 202*b*, which reduces or eliminates air turbulence, multi-directional airflow, and/or flow shearing of the airflow flowing into the fan arm portions 202*a*, 202*b*. Advantageously, the plenum facilitates smoother flow (e.g., laminar) in an intended direction (e.g., directly in front of the respective openings of the fan arm portions 202*a*, 202*b*) without requiring internal vanes or other airflow guiding protrusions within the lumens of the fan arm portions 202*a*, 202*b*.

Figure 4C:
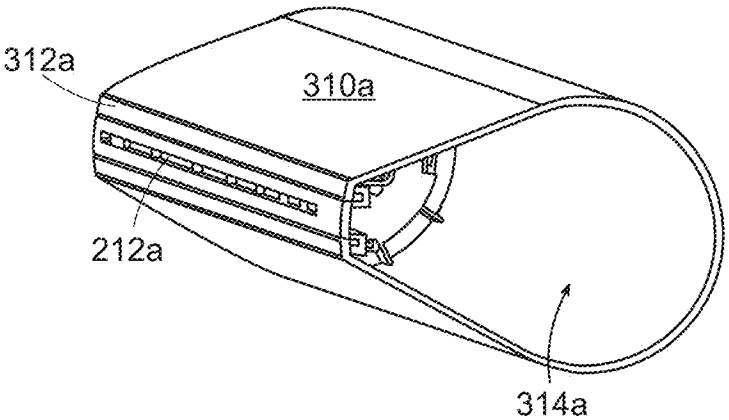
FIG. 4C is a perspective view of a portion of the fan arm of FIG. 4A.
Figure 4B:
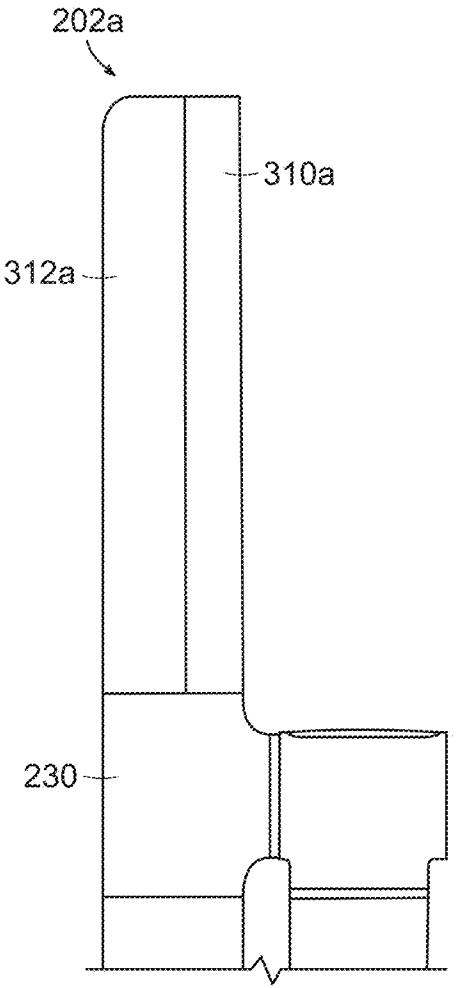
FIG. 4B is a side view of a portion of the fan arm of FIG. 4A.
Figure 4A:
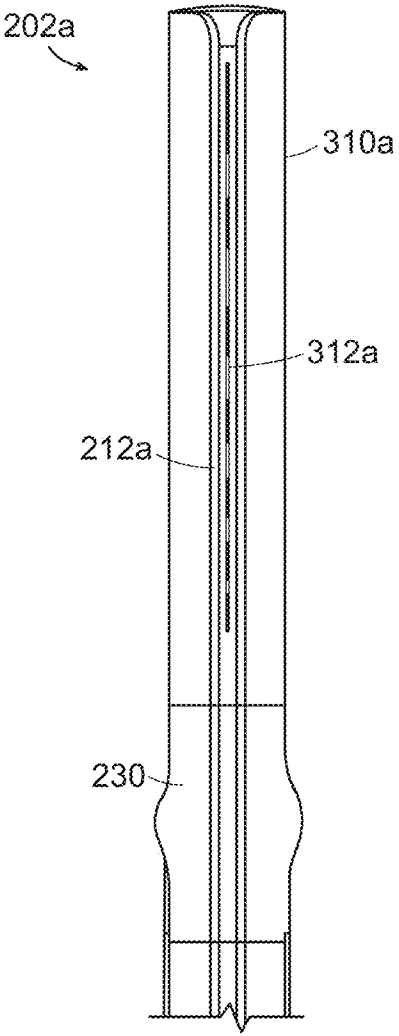
FIG. 4A is a front view of a portion of a fan arm of the bladeless fan of FIG. 2A.

The shape and structure of the nozzles of the fan arm portions 202*a*, 202*b* also contribute to the smoothness of airflow generated by the bladeless fan 200. To more clearly view the nozzle assembly, a close-up view of an example fan arm portion is presented herein. Referring now to FIGS. 4A-4E, an example of a first fan arm portion 202*a* having a nozzle 312*a* is presented in closer detail. As shown in FIGS. 4A-4D, the first fan arm portion 202*a* includes a first fan body 310*a* (which can be a portion of the fan housing 210 as described in FIGS. 2A-2B) and a first nozzle 312*a*. As shown in FIGS. 4C-4D, the first fan body 310*a* defines the first fan lumen 314*a* that can receive air from the fluid conduit 230. The first nozzle 312*a* extends from one side of the first fan body 310*a* and defines the first nozzle opening 212*a*. In some embodiments, the first nozzle 312*a* extends along a majority of a dominant dimension (e.g., length) of the fan body 310*a*. As shown in FIGS. 4A and 4C, one or more divider walls can be defined within the first nozzle opening 212*a*, which can further direct airflow towards the external environment in a direction desired by the user. The fan body 310*a* can have a tapered shape, such that a first end of the fan body 310*a* has a greater diameter than a diameter of a second end of the fan body 310*a*, with the first end of the fan body 310*a* being adjacent the first fluid conduit 230*a*. For example, the fan body 310*a* can form a nozzle 312*a* that is rounded on one end and pointed on another end, tapering toward the nozzle opening 212*a*. The tapered shape of the fan body 310*a* at least partially facilitates the uniform airflow described herein. The second fan arm 202*b* can have a similar shape. As shown in FIG. 4C, the fan body 310*a* and/or the nozzle 312*a* can have a teardrop-shaped cross-section. The nozzle opening 212*a* can be positioned along the narrowest point of the cross-section. In alternative embodiments, the fan arms do not have a tapered shape, and can have a cross-sectional shape such as an oval, a circle, a rectangle, or a combination thereof.

Figure 4E:
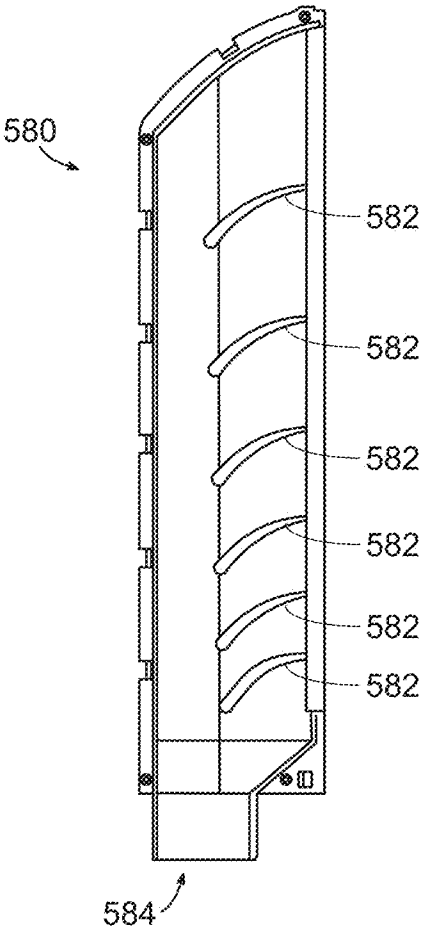
FIG. 4E is a cross-sectional view of an optional air guide of the fan arm of FIG. 4A.
Figure 4D:
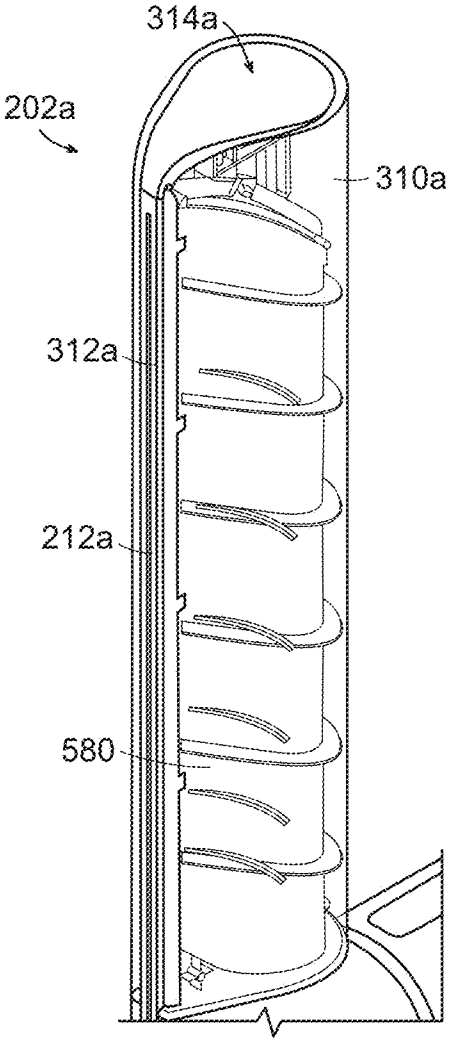
FIG. 4D is another perspective view of the portion of the fan arm of FIG. 4A.

As shown in FIGS. 4D-4E, an air guide 580 can be positioned within the first fan lumen 314*a* of the first fan arm portion 202*a* to redirect air towards the nozzle opening 212*a*. The air guide 580 can be optionally included in any of the fan arms of the bladeless fans described herein. For example, the air guide 580 can be positioned within a lumen of a fan arm such that airflow can be redirected through one or more nozzles thereof. The air guide 580 includes an opening 584 and a plurality of vanes 582 that can redirect airflow. The opening 584 is configured to be fluidically connected to a fluid flow path at least partially defined by an inner lumen of a fan arm, such as the lumen 314*a* of the first fan arm 202*a* shown in FIGS. 4B-4C. The vanes 582 can alter the direction of at least a portion of the airflow flowing through the fan arm lumen. For example, the air guide 580 could be positioned within the first fan arm 202*a* such that the vanes 582 are aligned with the opening 212*a* thereof.

Figure 5B:
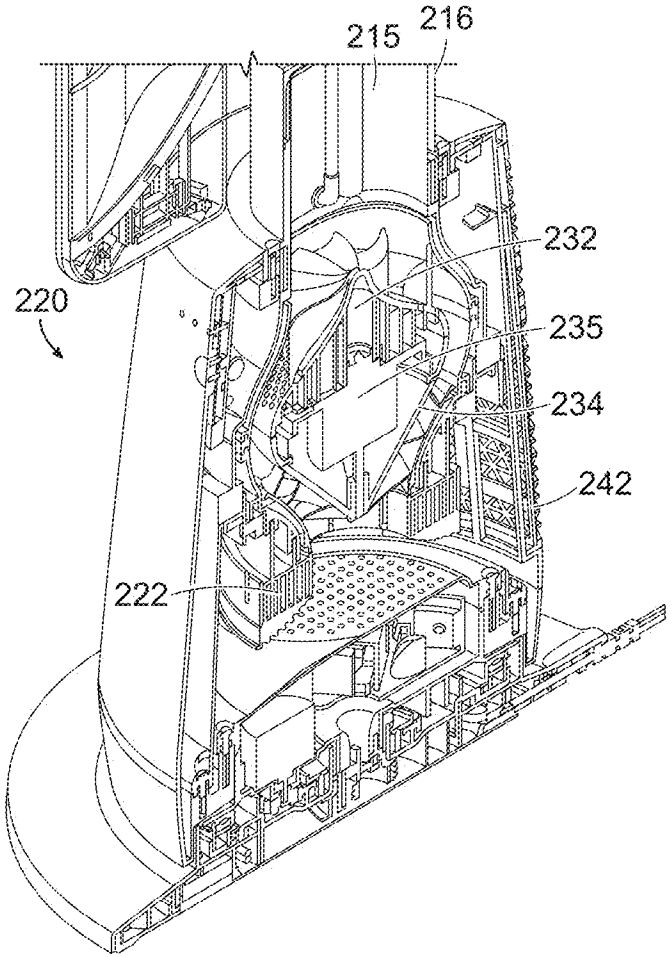
FIG. 5B is another cross-sectional view of the base of FIG. 5A.
Figure 5A:
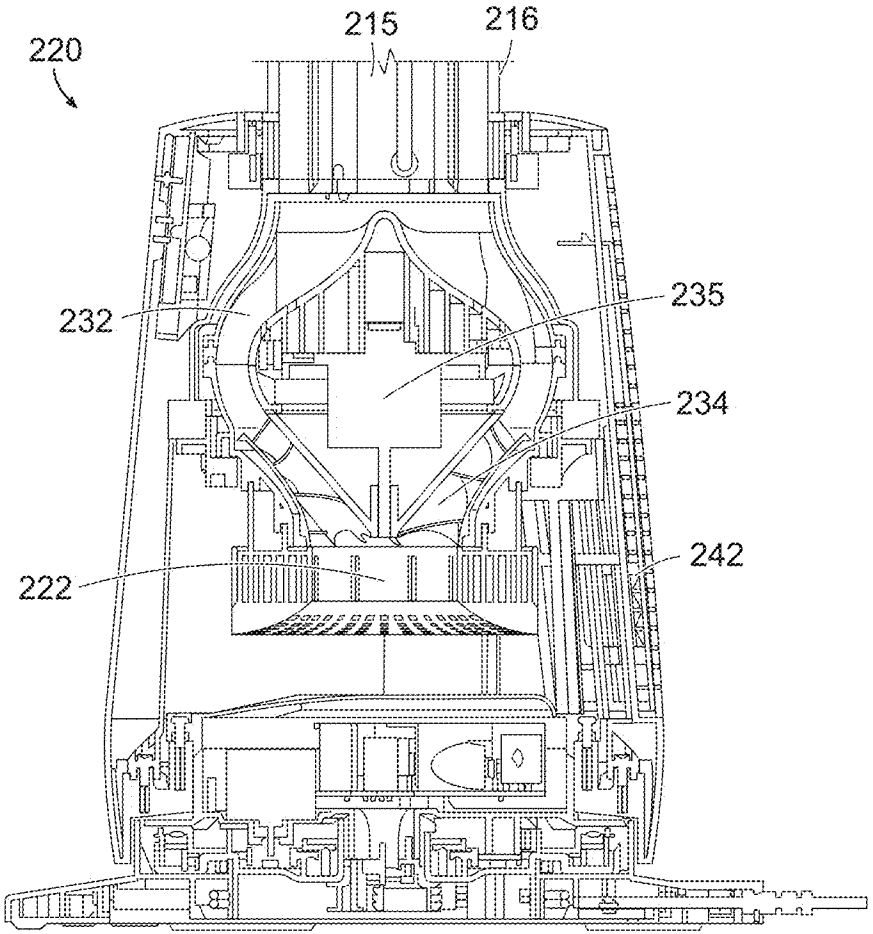
FIG. 5A is a cross-sectional view of an embodiment of a base of the bladeless fan of FIG. 2A.

The fan arms 101 and 202 of the bladeless fans 100 and 200 described herein can be compatible with a variety of bases (e.g., base 120 and base 220, as previously described). Close-up views of various examples of bases are presented herein For example, the base 220 of FIGS. 2A-2B is illustrated in greater detail in FIGS. 5A-5B. As shown in FIGS. 5A-5B, a portion of the base 220 defines a plurality of air inlets 222, which are fluidly connected to the impeller 234 and the diffuser 232. The plurality of air inlets 222 can receive air from the external environment and are similar to the air inlets 122 described with reference to FIGS. 1A-1D and inlets 222 of FIGS. 2A-2B. In some embodiments, the plurality of air inlets 222 can intake air via one or more through-holes, grates, or other openings in the housing of the base 220. For example, a perforated panel 242 can form a portion of the housing of the base 220 and can allow air to enter the base 220 and flow into the air inlets 222. The air received via the plurality of air inlets 222 is then supplied to the impeller 234 and he diffuser 232. The impeller 234 is operatively coupled to a motor 235, which rotates the impeller 234 in order to generate an airflow. The airflow generated by the impeller 234 then flows through a fluid flow path defined by the diffuser 232 and into an inner lumen (e.g., fluid conduit tube) positioned within the support rod 216.

Figure 6B:
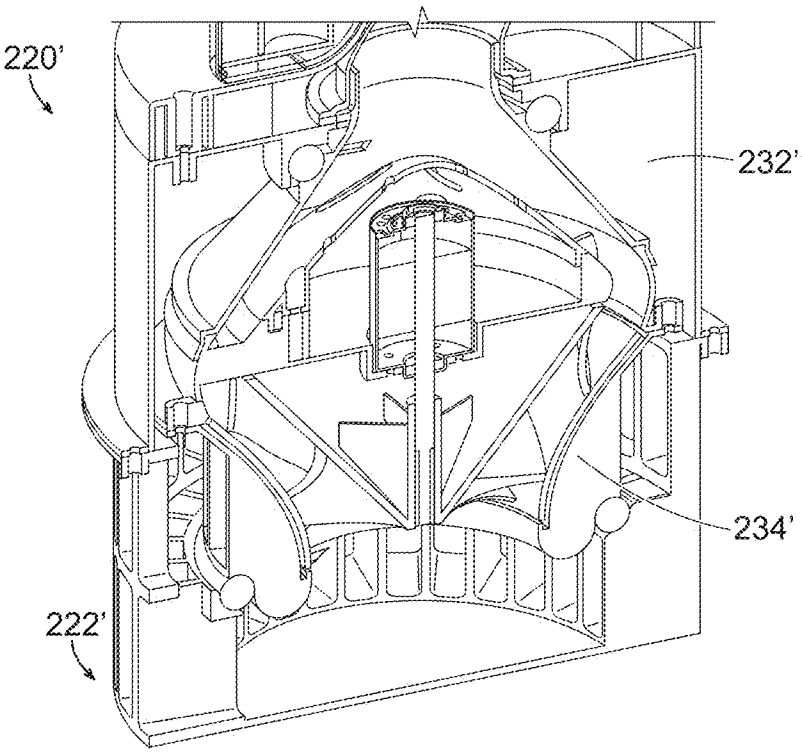
FIG. 6B is another cross-sectional view of the base of FIG. 6A.
Figure 6A:
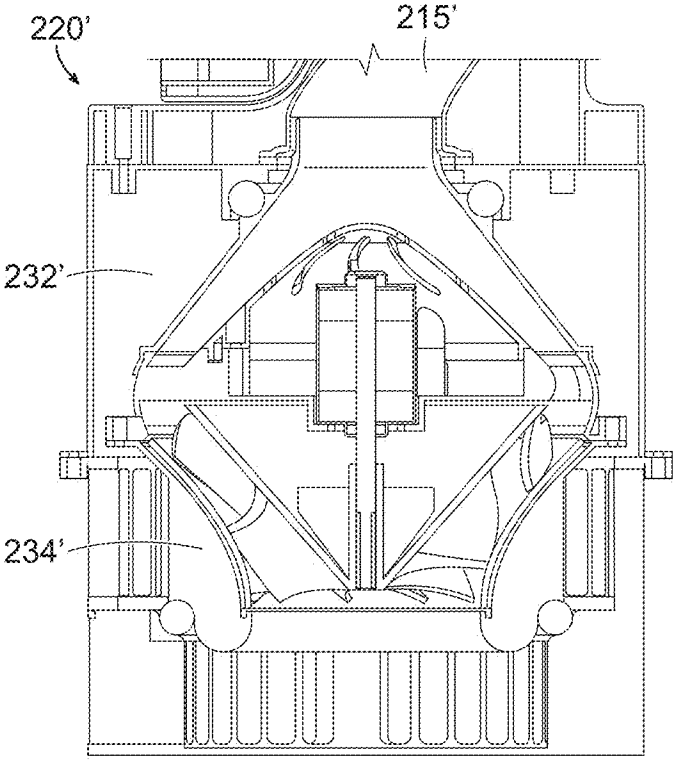
FIG. 6A is a cross-sectional view of another embodiment of a base of the bladeless fan of FIG. 2A.

FIGS. 6A-6B illustrate another embodiment of a base 220' of a bladeless fan. The base 220' in this illustrated embodiment is generally configured and used similar to the base 120 of the embodiment shown in FIGS. 1A-1D and/or the base 220 of FIGS. 5A-5B. As shown, the base 220' includes an impeller 334 and a diffuser 332. Details of the function and structure of the impeller 234' are generally similar to the description provided for the impeller 234 with reference to FIGS. 5A-5B.

Figure 7B:
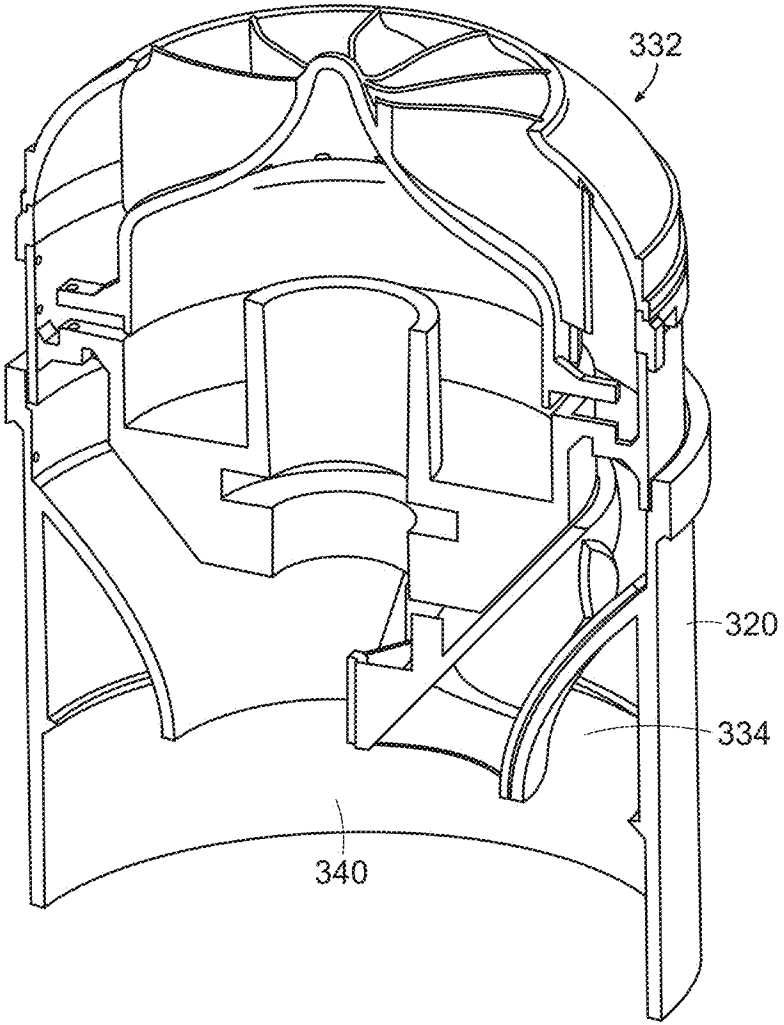
FIG. 7B is another cross-sectional view of the base of FIG. 7A.
Figure 7A:
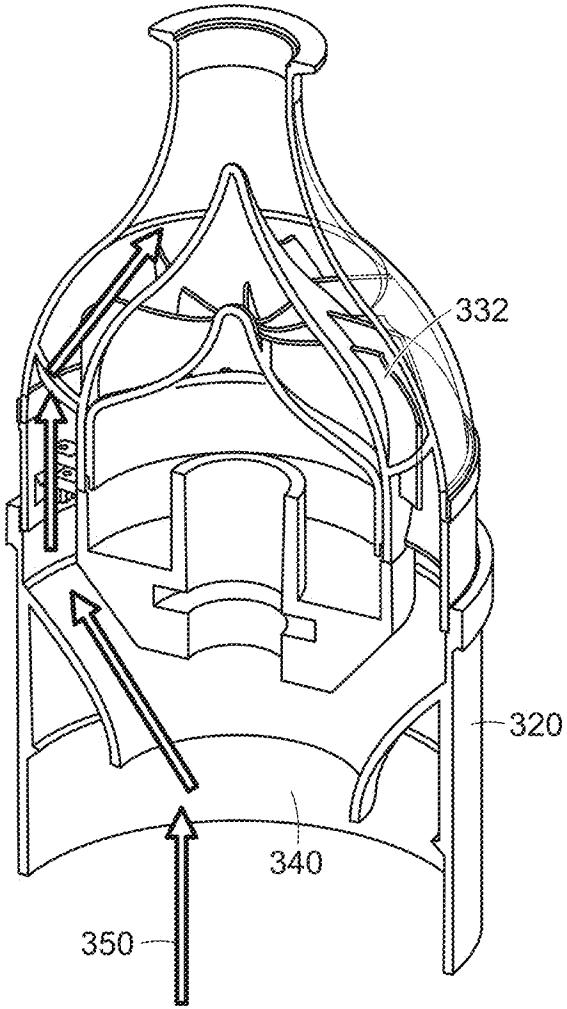
FIG. 7A is a cross-sectional view of yet another embodiment of a base of the bladeless fan of FIG. 2A.

FIGS. 7A-7B illustrate yet another embodiment of a base 320 of a bladeless fan. The base 320 in this illustrated embodiment is generally configured and used similar to the base 120 of the embodiment shown in FIGS. 1A-1D, the base 220 of FIGS. 5A-5B, and/or the base 220' of FIGS. 6A-6B. As shown, the base 320 includes an impeller 334 and a diffuser 332. Details of the function and structure of the impeller 334 are generally similar to the description provided for the impeller 234 with reference to FIGS. 5A-5B and/or the impeller 234' of FIGS. 6A-6B.

Figure 8:
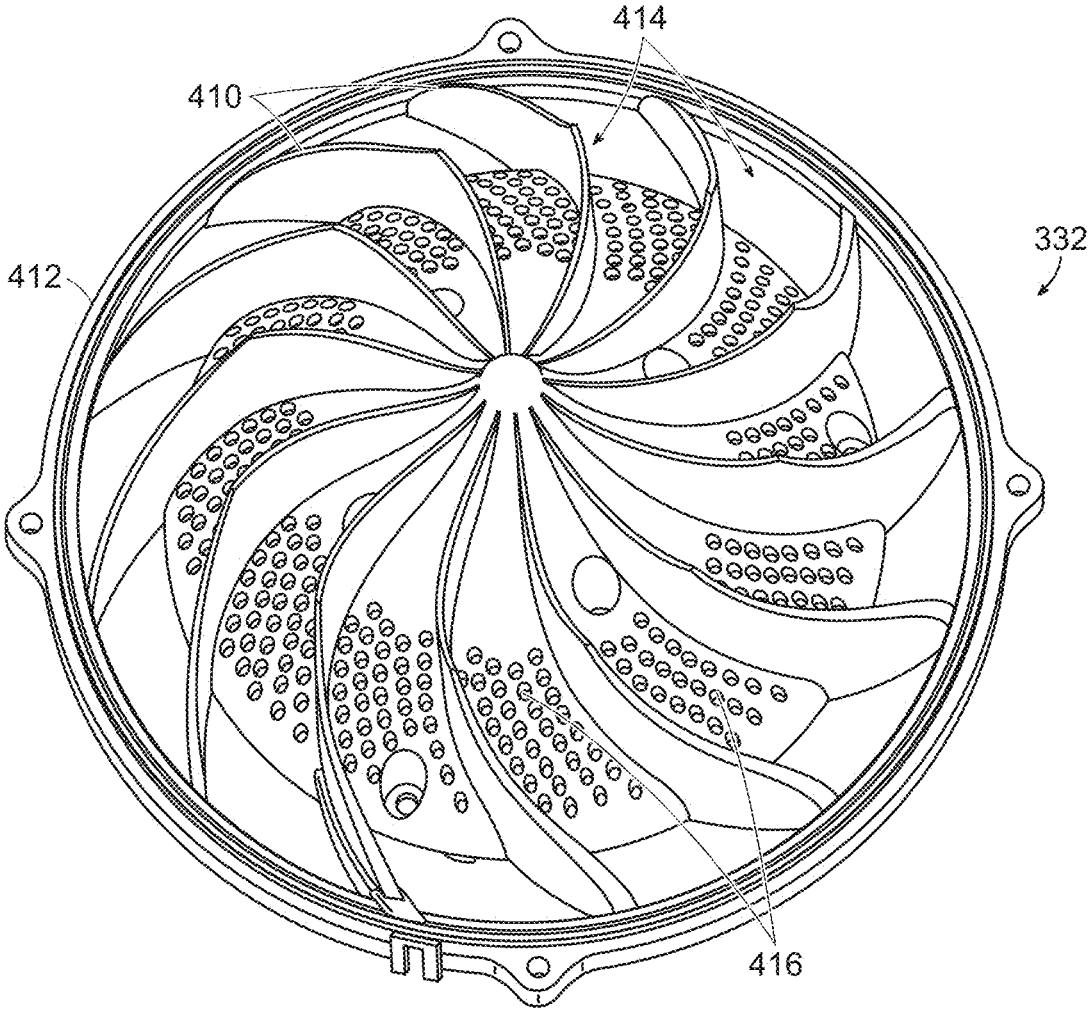
FIG. 8 is a perspective view of a diffuser of the base of FIG. 7A.

FIG. 8 further illustrates the diffuser 332. As shown, the diffuser 332 includes a diffuser body 412 and a plurality of blades 410. The plurality of blades 410 are radially spaced around a central axis and define a plurality of openings 414. The plurality of blades 410 can receive air from the impeller 334 and emit air into a lumen of a support rod. The plurality of blades 410 at least partially facilitates uniform airflow characteristics (e.g., flow direction) throughout the lumen of the support rod. In some embodiments, the plurality of blades 410 can include between about 2 and about 20 blades. The diffuser 332 can further include a plurality of through-holes 416 located on the diffuser body 412. The plurality of through-holes 416 can be smaller in size than the plurality of openings 414. In some embodiments, the plurality of through-holes 416 can limit, control, and/or otherwise restrict airflow through the diffuser body 412.

Figure 9B:
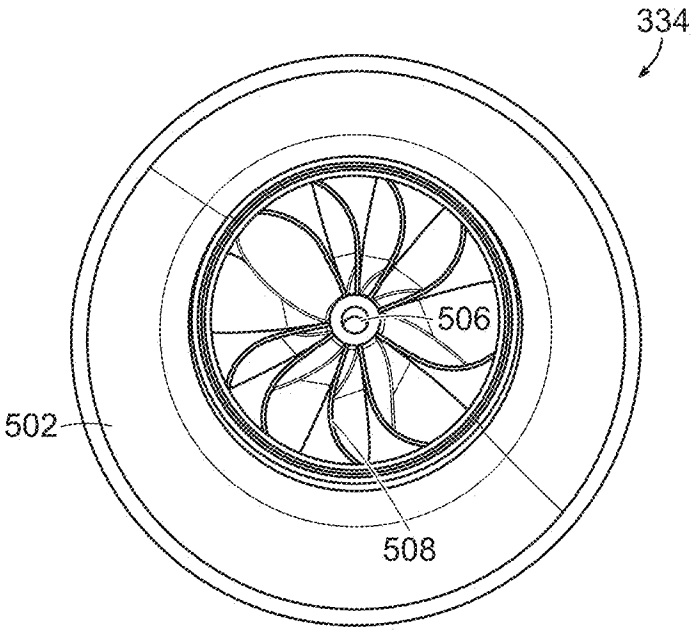
FIG. 9B is a bottom perspective view of the impeller of FIG. 7B.
Figure 9A:
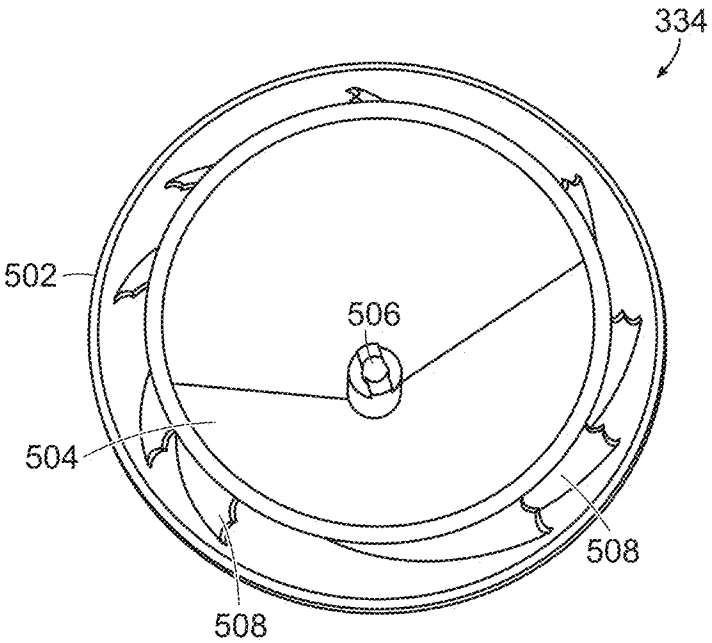
FIG. 9A is a top perspective view of an impeller of the base of FIG. 7A.

FIGS. 9A-9B further illustrate the impeller 334. As shown, the impeller 334 includes an outer housing 502, an inner housing 504, a driveshaft 506 formed on the inner housing 504, and a plurality of blades 508. The plurality of blades 508 are positioned between the outer housing 502 and the inner housing 504 and are radially spaced around the driveshaft 506. In some embodiments, the blades 508 are mounted to the inner housing 504 such that they are rotatable together with the inner housing 504. The driveshaft 506 can engage with a motor (not pictured), which spins the driveshaft 506 and rotates the blades 508. The blades 508 can move air between the outer housing 502 and the inner housing 504 when the driveshaft 506 is rotated by the motor. In some embodiments, the outer housing 502 and the inner housing 504 are tapered in shape such that the top of the impeller 334 (when it is mounted within the base) is wider than the bottom of the impeller 334. The outer housing 502 can have one or more openings at the bottom of the impeller 334 through which air enters the impeller 334.

Figure 10C:
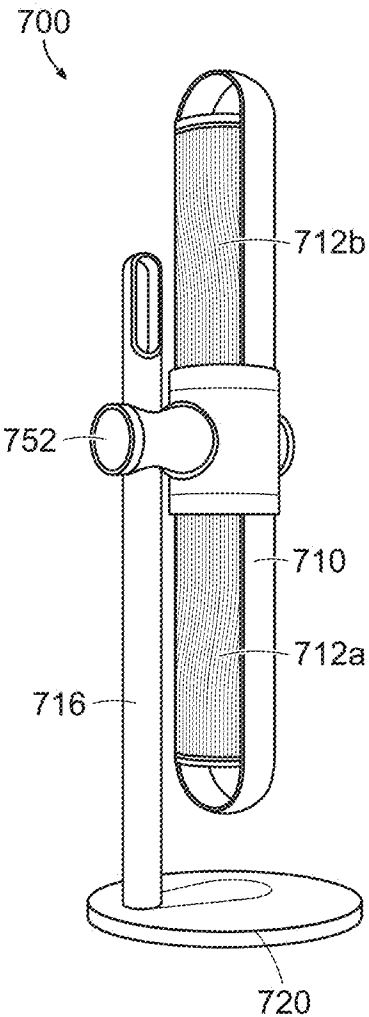
FIG. 10C is a rear perspective view of the bladeless fan of FIG. 10A.
Figure 10B:
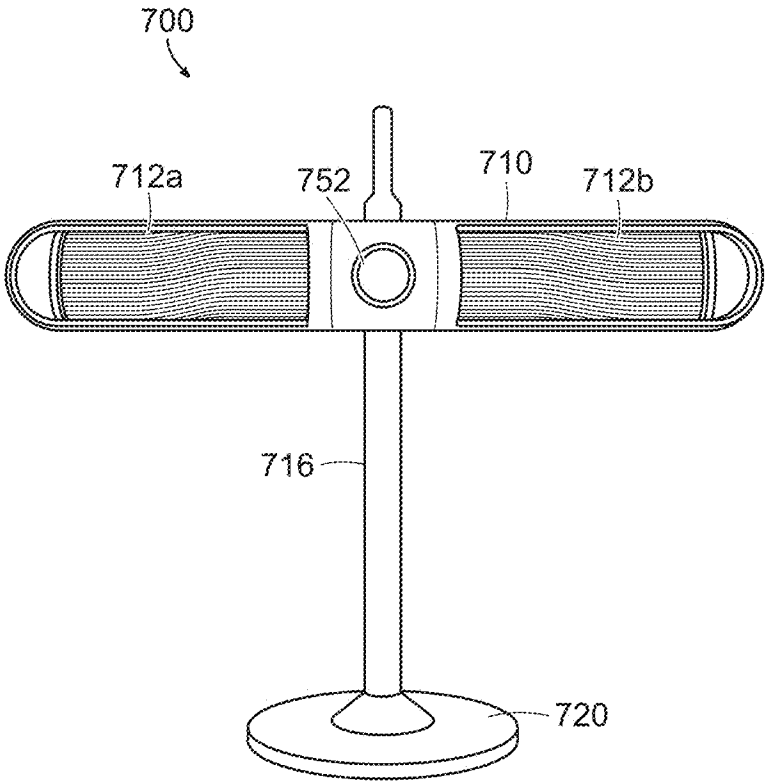
FIG. 10B is another front view of the bladeless fan of FIG. 10A.
Figure 10A:
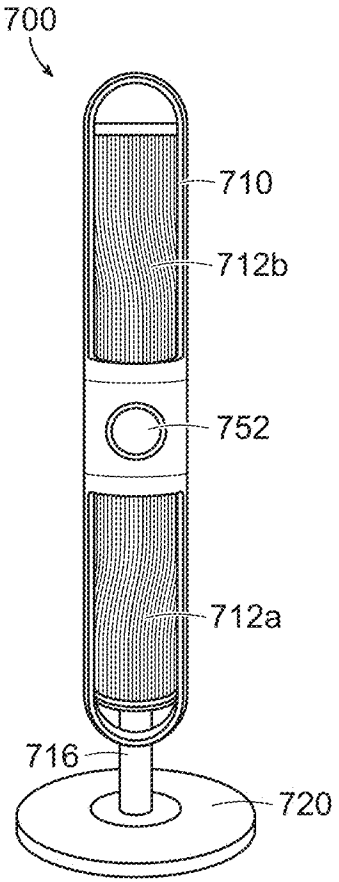
FIG. 10A is a front view of yet another embodiment of a bladeless fan.

FIGS. 10A-10C illustrate another embodiment of a bladeless fan 700 that includes a fan arm housing 710 and a compact base 720. The bladeless fan 700 in this illustrated embodiment is generally used similar to the bladeless fan 100 of FIGS. 1A-1D. Accordingly, it is to be understood that the bladeless fans 100 and 700 may share similar features, and the description of bladeless fan 700 may omit description of the features shared with the bladeless fan 100. As shown, the bladeless fan 700 includes the fan arm housing 710, a first opening 712*a*, a second opening 712*b*, a support rod 716, and the base 720. The first and second openings 712*a*, 712*b* are defined by first and second fan arm portions (obscured in the figures) positioned within the fan arm housing 710. In this embodiment, the impeller, diffuser, and motor (obscured in the figures) are housed within the fan arm housing 710. A single impeller, diffusor, and motor can be used to emit airflow through each of the first and second fan arms and out both of the openings 712*a*, 712*b*, although alternative embodiments can include more than one of each component. The fan arm housing 710 is coupled to the support rod 716 by an axle 752. The axle 752 defines an axis of rotation for the fan arm housing 710. For example, FIG. 10A shows the fan arm housing 710 in a first configuration (e.g., parallel to the support rod 716) and FIG. 10B shows the fan arm housing 710 in a second configuration (e.g., perpendicular to the support rod 716), with the fan arm housing 710 transitioning between the first and second configuration by rotating about the axis defined by the axle 752. The base 720 is a compact structure that can support the bladeless fan 700 in an upright position on a ground surface. The support rod 716 is coupled to an upper surface of the base 720.

Figure 11B:
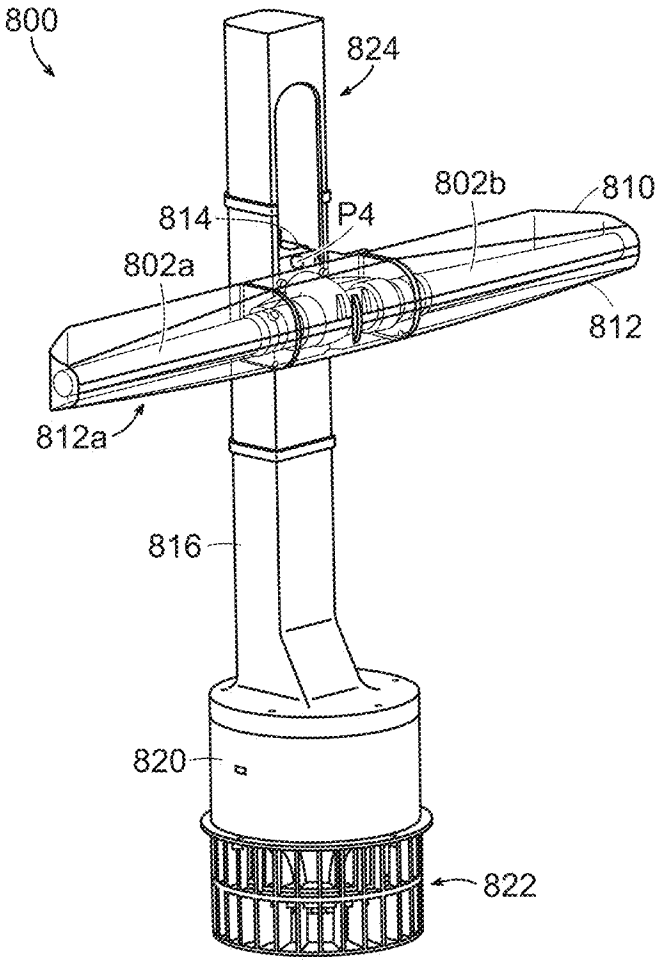
FIG. 11B is a perspective view of the bladeless fan of FIG. 11A.
Figure 11A:
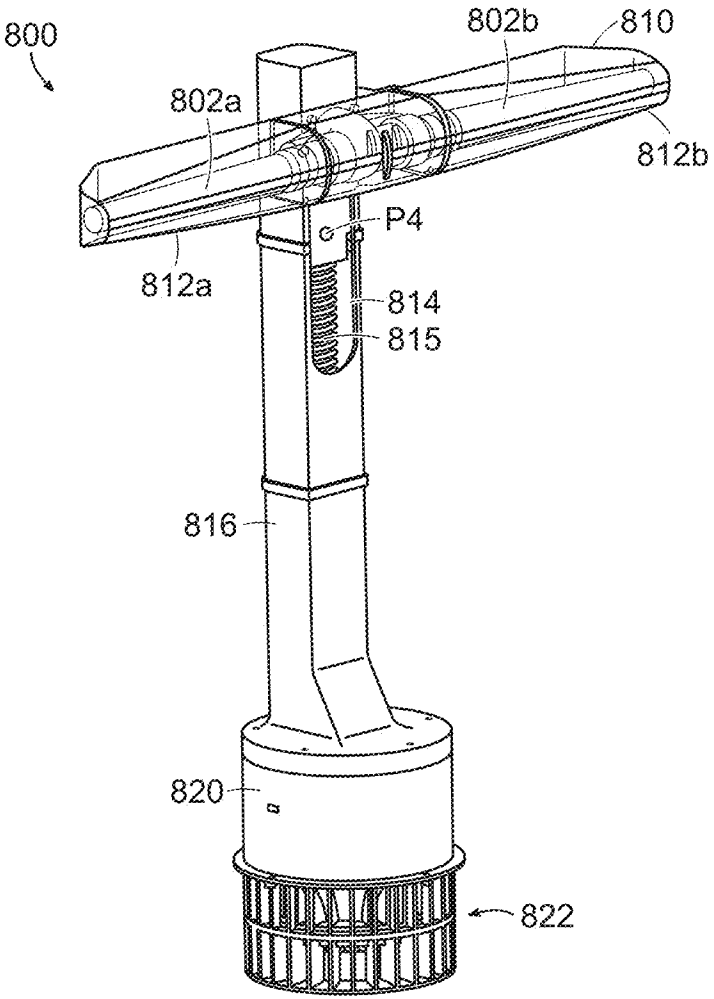
FIG. 11A is a perspective view of an additional embodiment of a bladeless fan.

FIGS. 11A-11B illustrate an additional embodiment of a bladeless fan 800 that includes a fan arm housing 810 that can be translated across the length of a support rod 816. As shown, the fan arm housing 810 is in a second configuration, similar to the second configuration described with reference to FIG. 1B. The bladeless fan 800 in this illustrated embodiment is generally configured and used similar to the bladeless fan 100 of the embodiment shown in FIGS. 1A-1D. Accordingly, it is to be understood that the bladeless fans 100 and 800 may share similar features, and the description of bladeless fan 800 may omit description of the features shared with the bladeless fan 100. As shown in FIGS. 11A-11B, the bladeless fan 800 includes a fan arm housing 810 that houses the fan arm portions 802*a*, 802*b*, a support rod 816, and a base 820. The support rod 816 includes an opening 814 that defines the possible vertical positions of the fan arm housing 810. For example, as shown in FIG. 11B, the fan arm housing 810 can be positioned at a lower end of the opening 814, such that the fan arm housing 810 is positioned at a first distance from the base 820. As another example, as shown in FIG. 11A, the fan arm housing 810 can be positioned at an upper end of the opening 814, such that the fan arm housing 810 is positioned at a second distance from the base 820. The fan arm housing 810 can also be positioned at any position between the upper and lower ends of the opening 814.

In some embodiments, a portion of the base 820 defines a plurality of air inlets 822 that can receive air from the external environment. The air received via the plurality of air inlets 822 is then supplied to an impeller and a diffuser (obscured in the figures). The impeller is operatively coupled to a motor (obscured in the figures), which can rotate the impeller in order to generate an air flow. The air flow generated by the impeller then flows through a fluid flow path defined by the diffuser and into a fluid conduit 815 (e.g., tube) positioned within the support rod 816. The fluid conduit 815 is visible through the opening 814 as shown in FIG. 11A. In some embodiments, the fluid conduit 815 is an extendable tube that changes in length based on the movement of the fan arm housing 810 between the upper and lower ends of the opening 814. The movement of the fan arm housing 810 can be performed using an adjustment point P4 that includes a sliding joint.

The bladeless fans described herein can have any reasonable size, shape, material composition, or form factor. For example, the base, the support rod (also referred to herein as a "support arm" or an "elongate support"), the connection joint (also referred to herein as "point P1") the fan arm, and the nozzles can have any reasonable length, diameter, circumference, cross-section, etc. In some embodiments, the length of the fan arm is greater than the length of the support rod. For example, the fan arm can have a length that is about two times greater than a length of the elongate support. In some embodiments, the length of the fan arm is greater than the length of the base. For example, the fan arm can have a length that is about three times greater than a length of the base. In some embodiments, the length of the support rod can be variable due to the telescoping and/or adjustable nature of the support rod. For example, the support rod can be adjustable in length such that a length of the support rod is between about 50 percent and about 100 percent of a length of the fan arm. In some embodiments, the length of each nozzle opening is less than the length of the respective fan arm portion. For example, the first and second fan arm portions can each include a nozzle opening having a length that is about 90 percent of a length of the respective fan arm portion. In some embodiments, the diameter/circumference of the inner lumen of the support rod is greater than the diameter/circumference of the fan arm. For example, a maximum diameter of the inner lumen can be approximately two times greater than a maximum diameter of first or second fan lumens formed within the first or second fan arm portions, respectively. In another example, a maximum circumference of the inner lumen is greater than a maximum circumference of the first and second fan lumens. In some embodiments, the support rod is sized such that it is longer than it is wide. For example, the length of the support rod can be about five times greater than a maximum diameter of the inner lumen of the support rod.

One skilled in the art will appreciate further features and advantages of the devices, systems, and methods based on the above-described embodiments. Accordingly, this disclosure is not to be limited by what has been particularly shown and described, except as indicated by the appended claims. All publications and references cited herein are expressly incorporated herein by reference in their entirety for all purposes.

The present disclosure has been described above by way of example only within the context of the overall disclosure provided herein. It will be appreciated that modifications within the spirit and scope of the claims may be made without departing from the overall scope of the present disclosure.

What is claimed is:

1. A bladeless fan, comprising:

a base comprising an interior having an impeller disposed therein;

a support rod extending from the base, the support rod having an inner lumen in fluid communication with the interior of the base; and a fan arm rotatably coupled to the support rod, the fan arm having first and second rotatable fan arm portions positioned on opposite ends of the fan arm, and first and second nozzles positioned on the first and second rotatable fan arm portions, respectively, the first and second nozzles having first and second fan lumens, respectively, in fluid communication with the inner lumen;

wherein rotation of the impeller is configured to generate airflow that flows into the interior of the base, through the inner lumen of the support rod, and through the first and second fan lumens to be emitted from the first and second nozzles, and wherein the first nozzle has a teardrop-shaped cross-section and tapers toward a first nozzle opening positioned along a narrowest point of the cross-section.

2. The bladeless fan of claim 1, further comprising a fluid separator coupled to the fan arm and configured to separate the airflow generated by the rotation of the impeller into first and second airflow portions, the first airflow portion being directed toward the first nozzle and the second airflow portion being directed toward the second nozzle.

3. The bladeless fan of claim 2, wherein the first and second airflow portions are independently adjustable such that an amount of airflow emitted from each of the first and second nozzles is independently adjustable.

4. The bladeless fan of claim 2, wherein the fluid separator deflects airflow by approximately 90 degrees as it exits the inner lumen of the support rod.

5. The bladeless fan of claim 1, wherein the first and second nozzles are disposed within the first and second fan arm portions, respectively.

6. The bladeless fan of claim 1, wherein the first and second nozzles taper toward first and second nozzle openings, respectively, the first and second nozzle openings being shaped to produce a laminar airflow.

7. The bladeless fan of claim 6, wherein the first and second nozzle openings comprise slots extending along a longitudinal axis of the fan arm.

8. The bladeless fan of claim 6, wherein a direction of airflow exiting the first and second nozzle openings is normal to a surface of the fan arm housing surrounding the first and second nozzle openings.

9. The bladeless fan of claim 1, wherein the base comprises a plurality of air inlets configured to intake air into the interior of the base.

10. The bladeless fan of claim 9, wherein the plurality of air inlets are positioned on a removable perforated panel.

11. The bladeless fan of claim 1, further comprising a diffuser disposed within the interior of the base, the diffuser being configured to evenly distribute air across the inner lumen of the support rod.

12. The bladeless fan of claim 11, wherein the diffuser is positioned downstream of the impeller and upstream of the support rod.

13. A bladeless fan, comprising:

a base, a support arm extending from the base, and a fan arm movably coupled to the support arm and having first and second nozzles on opposed sides thereto, the first and second nozzles being configured to emit airflow along a plane, and the base, support arm, and fan arm being configured to allow independent adjustment of an amount of airflow from each of the first and second nozzles, independent adjustment of a direction of airflow from each of the first and second nozzles, and adjustment of a position of the plane, wherein the first nozzle has a teardrop-shaped cross-section and tapers toward a first nozzle opening positioned along a narrowest point of the cross-section.

14. The bladeless fan of claim 13, wherein the base includes an impeller configured to generate airflow which flows up through an inner lumen in the support arm and into first and second fan lumens in the fan arm to be emitted from the first and second nozzles.

15. The bladeless fan of claim 13, wherein the base includes a diffuser configured to evenly distribute airflow across an inner lumen of the support arm.

16. The bladeless fan of claim 13, further comprising a fluid separator coupled to the fan arm and configured to direct airflow into the first and second nozzles.

17. The bladeless fan of claim 16, wherein the fluid separator is configured to allow independent adjustment of an amount of airflow reaching each of the first and second nozzles.

18. The bladeless fan of claim 13, wherein the first and second nozzles are configured to emit airflow along a first plane and a second plane, respectively, and wherein the first plane is different from the second plane.

19. The bladeless fan of claim 13, wherein adjustment of a position of the plane comprises a rotation of at least a portion of the fan arm relative to a longitudinal axis of the fan arm.

* * * * *